US011034001B2

(12) United States Patent
Watson et al.

(10) Patent No.: US 11,034,001 B2
(45) **Date of Patent: *Jun. 15, 2021**

(54) RETENTION APPARATUS FOR PORTIONS OF ADJUSTABLE WRENCH

(71) Applicant: THRU TUBING SOLUTIONS, INC., Oklahoma City, OK (US)

(72) Inventors: Brock Watson, Oklahoma City, OK (US); Roger Schultz, Newcastle, OK (US); Greg Kliewer, Edmond, OK (US); Andy Ferguson, Moore, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 369 days.

This patent is subject to a terminal disclaimer.

(21) Appl. No.: 16/204,992

(22) Filed: Nov. 29, 2018

(65) Prior Publication Data

US 2019/0152027 A1 May 23, 2019

Related U.S. Application Data

(62) Division of application No. 14/899,030, filed as application No. PCT/US2015/026712 on Apr. 20, 2015, now Pat. No. 10,189,149.

(60) Provisional application No. 61/981,284, filed on Apr. 18, 2014.

(51) Int. Cl.

| | |
|---|---|
| ***B25B 13/50*** | (2006.01) |
| ***B25B 7/02*** | (2006.01) |
| ***B25B 7/12*** | (2006.01) |
| ***B25B 13/14*** | (2006.01) |
| ***B25B 7/04*** | (2006.01) |
| ***B25B 13/12*** | (2006.01) |
| ***B25B 13/58*** | (2006.01) |
| ***B25B 29/00*** | (2006.01) |

(52) U.S. Cl.

CPC ..... *B25B 13/5058* (2013.01); *B25B 7/02* (2013.01); *B25B 7/04* (2013.01); *B25B 7/123* (2013.01); *B25B 13/12* (2013.01); *B25B 13/14* (2013.01); *B25B 13/58* (2013.01); *B25B 29/00* (2013.01)

(58) Field of Classification Search

CPC ..... B25B 13/5058; B25B 13/12; B25B 13/14; B25B 13/58; B25B 7/02; B25B 7/04; B25B 7/123

See application file for complete search history.

(56) References Cited

U.S. PATENT DOCUMENTS 1,777,084 A * 9/1930 Heer ..... B25B 13/5058 81/57.32
4,380,941 A 4/1983 Petersen
6,119,558 A 9/2000 Foley, Jr.
(Continued)

FOREIGN PATENT DOCUMENTS

WO 2011126797 A2 10/2011

OTHER PUBLICATIONS

PCT/US2015/026712; "International Search Report and Written Opinion"; dated Jun. 29, 2015; 16 pages.

*Primary Examiner* — David B. Thomas
(74) *Attorney, Agent, or Firm* — Hall Estill Law Firm

(57) ABSTRACT

The present disclosure is directed to an apparatus for use with an adjustable wrench to limit the displacement of a broken portion of the adjustable wrench relative to the remaining parts of the adjustable wrench when the wrench fractures.

29 Claims, 28 Drawing Sheets

(56) References Cited

U.S. PATENT DOCUMENTS

| | | | | |
|---|---|---|---|---|
| 6,202,516 | B1 | 3/2001 | Kim | |
| 6,339,980 | B1 | 1/2002 | Woolf | |
| 6,571,667 | B2 * | 6/2003 | Price | E21B 19/161 81/57.15 |
| 9,339,100 | B2 * | 5/2016 | Moreau | A45F 5/00 |
| 9,402,457 | B2 * | 8/2016 | Moreau | A44B 13/02 |
| 9,610,676 | B2 | 4/2017 | Kundracik et al. | |
| 9,968,180 | B2 * | 5/2018 | Moreau | A45F 5/00 |
| 2005/0011321 | A1 | 1/2005 | Hsien | |
| 2010/0050819 | A1 | 3/2010 | Nam | |

* cited by examiner

RETENTION APPARATUS FOR PORTIONS OF ADJUSTABLE WRENCH

CROSS-REFERENCE TO RELATED APPLICATIONS

The present application is a divisional application of a U.S. Application having U.S. Ser. No. 14/899,030, filed Dec. 16, 2015, which claims the priority to a PCT application having International Application No. PCT/US2015/026712, filed Apr. 20, 2015, which claims priority to U.S. Provisional Application having U.S. Ser. No. 61/981,284, filed Apr. 18, 2014, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a wrench that includes a restraint apparatus to control components of the wrench to prevent injury to a user of the wrench, or other personnel, when the wrench fails.

2. Description of the Related Art

Traditionally, adjustable wrenches can be pushed to their physical limitation. When this occurs, a portion of the wrench can fracture off and potentially injure someone. Typically, the fracture occurs close to a jaw portion of the wrench (see FIGS. 1 and 12).

SUMMARY OF THE DISCLOSURE

This disclosure is directed toward a restraint device that is attached to at least one part of an adjustable wrench to limit the displacement of a broken portion of the adjustable wrench relative to the adjustable wrench after the adjustable wrench fails or fractures.

DETAILED DESCRIPTION OF THE DISCLOSURE

Figure 1:
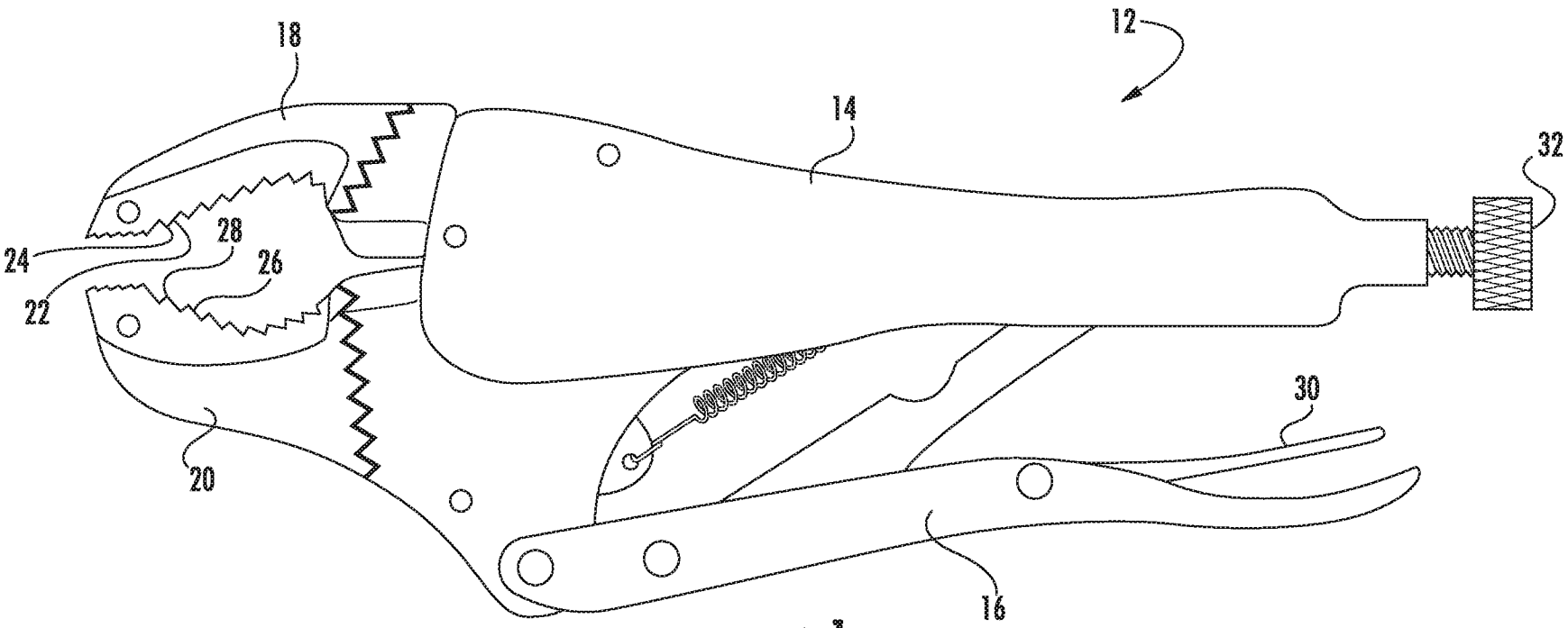
FIG. 1 is a side elevation view of an adjustable wrench.

The present disclosure relates to a restraint device or apparatus 10 for an adjustable wrench 12 to maintain control or limit the displacement of portions of the adjustable wrench 12 should the adjustable wrench 12 fail during engagement with a work object (not shown) and break into pieces. The restraint apparatus 10 can be used in conjunction with any type of wrench, pliers, etc., known in the art.

The adjustable wrench 12 can be any type of wrench having fixed and/or movable jaws. In one exemplary embodiment shown in FIGS. 1-11, the adjustable wrench 12 includes a first handle 14 and a second handle 16 that cooperate to operate a first jaw 18 and a second jaw 20 to engage the work object. The handles 14 and 16 can be configured in any manner such that they force the first and second jaws 18 and 20 toward each other to grip the work object. The first and second jaws 18 and 20 can be fixed or movable with respect to the first and/or second handle 14, 16. The first jaw 18 can be provided with a first gripping surface 22 to increase the engageability of the first jaw 18 on the work object. Furthermore, the first gripping surface can include at least one tooth 24 to further increase the engageability of the first jaw 18 on the work object. Similarly, the second jaw 20 can be provided with a second gripping surface 26 to increase the engageability of the second jaw 20 on the work object. Furthermore, the second gripping surface 26 can include at least one tooth 28 to further increase the engageability of the second jaw 20 on the work object.

In one embodiment, the first handle 14 and the first jaw 18 are securely supported by one another and the second handle 16 and the second jaw 20 are movable with respect to the first handle 14 and the first jaw 18. In another embodiment, the adjustable wrench can include a locking apparatus 30 for securing the adjustable wrench 12 in a certain position or securely to the work object. The adjustable wrench 12 can also include an adjustment apparatus 32 for adjusting the distance between the first jaw 18 and the second jaw 20 when the adjustable wrench 12 is in the locked and unlocked position.

In various embodiments shown in FIGS. 2-11, the wrench 12 can also include the restraint apparatus 10 wherein the restraint apparatus 10 can take on numerous forms. The restraint apparatus 10 can be any device attachable to any portion of the wrench 12 that limits the displacement between a broken portion of the wrench 12 and any other portion of the wrench 12. In most scenarios, the jaws 18 or 20 are the parts of the wrench 12 that fail, thus the relative displacement between the broken portion of the jaws 18 or 20, or any other part of the wrench 12, is limited when the jaws 18, 20 fail. The relative displacement between the broken portion of the jaws 18, 20 is also limited between the broken portion of the jaws 18 or 20 and the first or second handle 14, 16 of the wrench 12.

Figure 2:
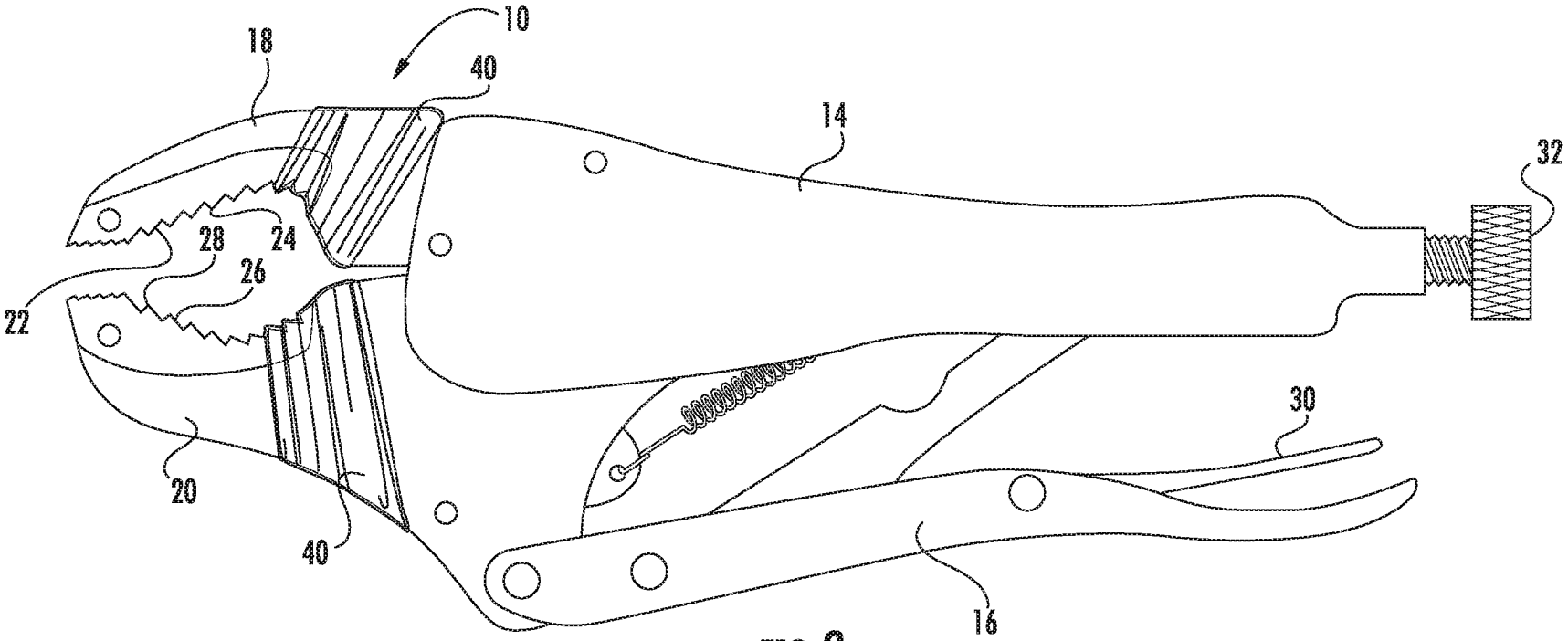
FIG. 2 is a side elevation view of an adjustable wrench including a restraint apparatus constructed in accordance with the present disclosure.
Figure 3:
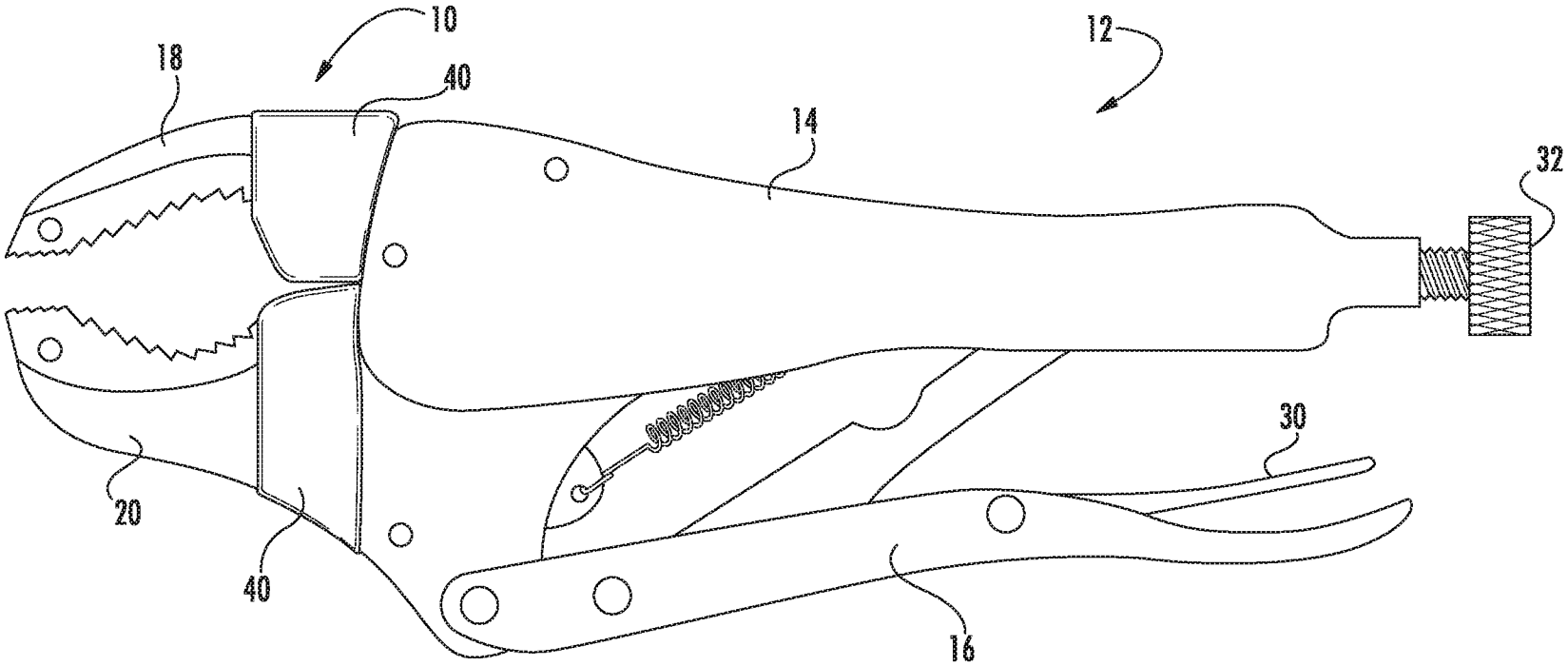
FIG. 3 is a side elevation view of an adjustable wrench including another embodiment of the restraint apparatus constructed in accordance with the present disclosure.
Figure 4:
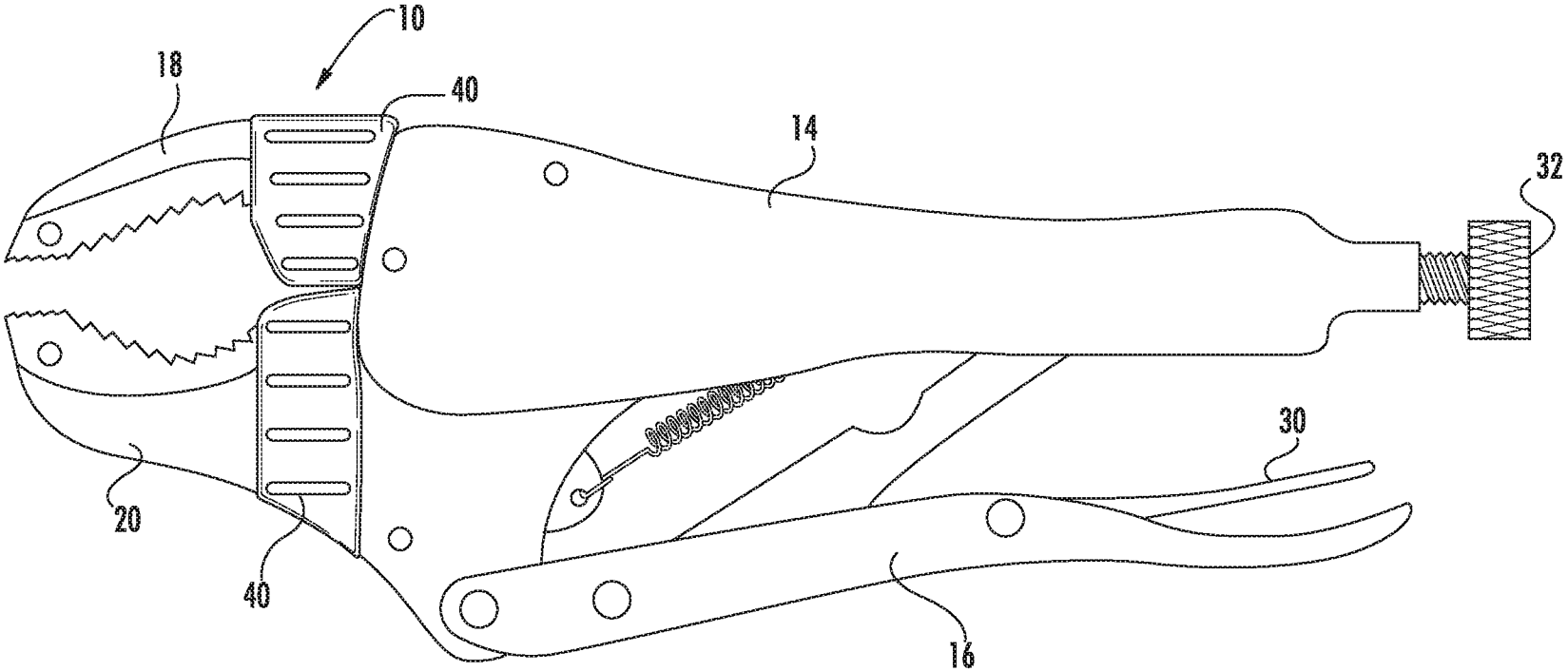
FIG. 4 is a side elevation view of an adjustable wrench including another embodiment of the restraint apparatus constructed in accordance with the present disclosure.

More specifically, and shown in FIGS. 2-4, the restraint apparatus 10 includes at least one layer of material 40 to cover a portion of first jaw 18 or the second jaw 20. The layer of material 40 works to retain any portion of the first jaw 18 or the second jaw 20 that may fracture off or substantially reduce the velocity of the fractured portion of the first jaw 18 or the second jaw 20. The layer of material 40 may cover the first jaw 18 or the second jaw 20 except for the gripping surfaces 22 and 26 disposed on the first jaw 18 or the second jaw 20.

In the embodiments shown in FIGS. 2-4, the at least one layer of material 40 can be a shrink wrap material, tape, plastic, rubber, polymeric material, elastomeric material, a metallic material, a metal, a combination thereof, or any other material known in the art capable of restraining, collecting, or limiting the movement of any fractured pieces of the wrench 12. The at least one layer of material 40 can be coated on the first jaw 18 or the second jaw 20 and/or held in place on the first jaw 18 or the second jaw 20 via any manner known in the art. Examples include, but are not limited to, adhesive material, shrink wrap, metal rings, crimped metal, fasteners, Velcro®, magnets, braze, and the like.

In another embodiment, the metal can be formed and fastened to portions of the first jaw 18 or the second jaw 20. The metal may be positioned on one or both sides of the first jaw 18 or the second jaw 20 or it may be positioned such that it bends around the first jaw 18 or the second jaw 20. The metal may also be covered with rubber, plastic, heat shrink tubing, tape, an elastomeric material, a polymeric material, or any other common fastening means.

Figure 5A:
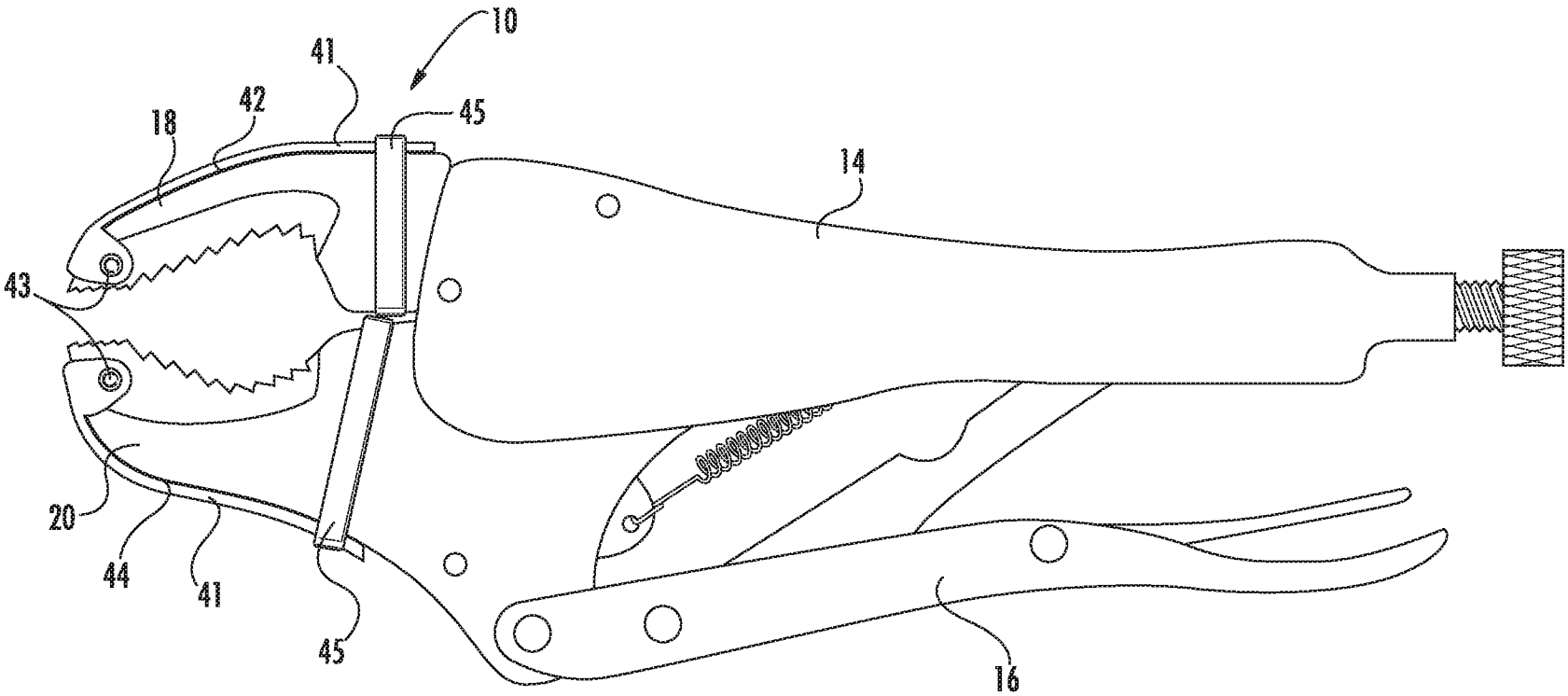
FIGS. 5A and 5B are side elevation views of an adjustable wrench including further embodiments of the restraint apparatus constructed in accordance with the present disclosure.
Figure 5B:
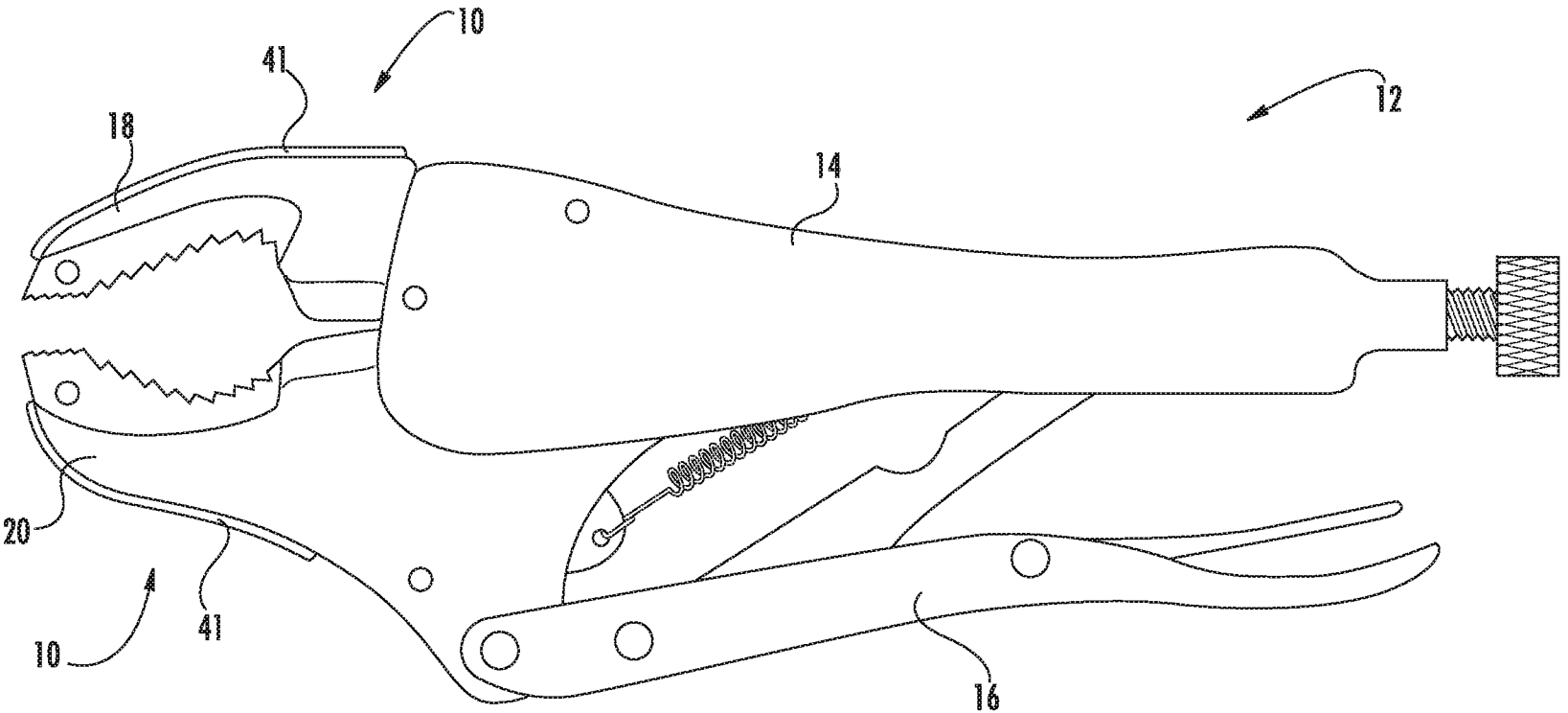

In another embodiment of the present disclosure, shown in FIGS. 5A and 5B, the restraint apparatus 10 is a strip of material 41, such as metal strip, wire, braze, Kevlar® fiber or film, or weld string disposed on an outer portion 42 of the first jaw 18 which extends across the typical fracture area of the first jaw 18 or an outer portion 44 of the second jaw 20 which extends across the typical fracture area of the second jaw 20. The strip of material 41 may have elastic properties and be fastened to the first jaw 18 or the second jaw 20 via any manner known in the art. Examples include, but are not limited to, glue, rivets, adhesive material, shrink wrap, metal rings, crimped metal, fasteners, Velcro®, magnets, braze, and the like. The strip of material 41 can be elastomeric and/or metallic material. In one embodiment shown in FIG. 5A, the strip of material 41 is secured to the first jaw 18 or the second jaw 20 via a rivet 43 and a ring of material 45.

Figure 6:
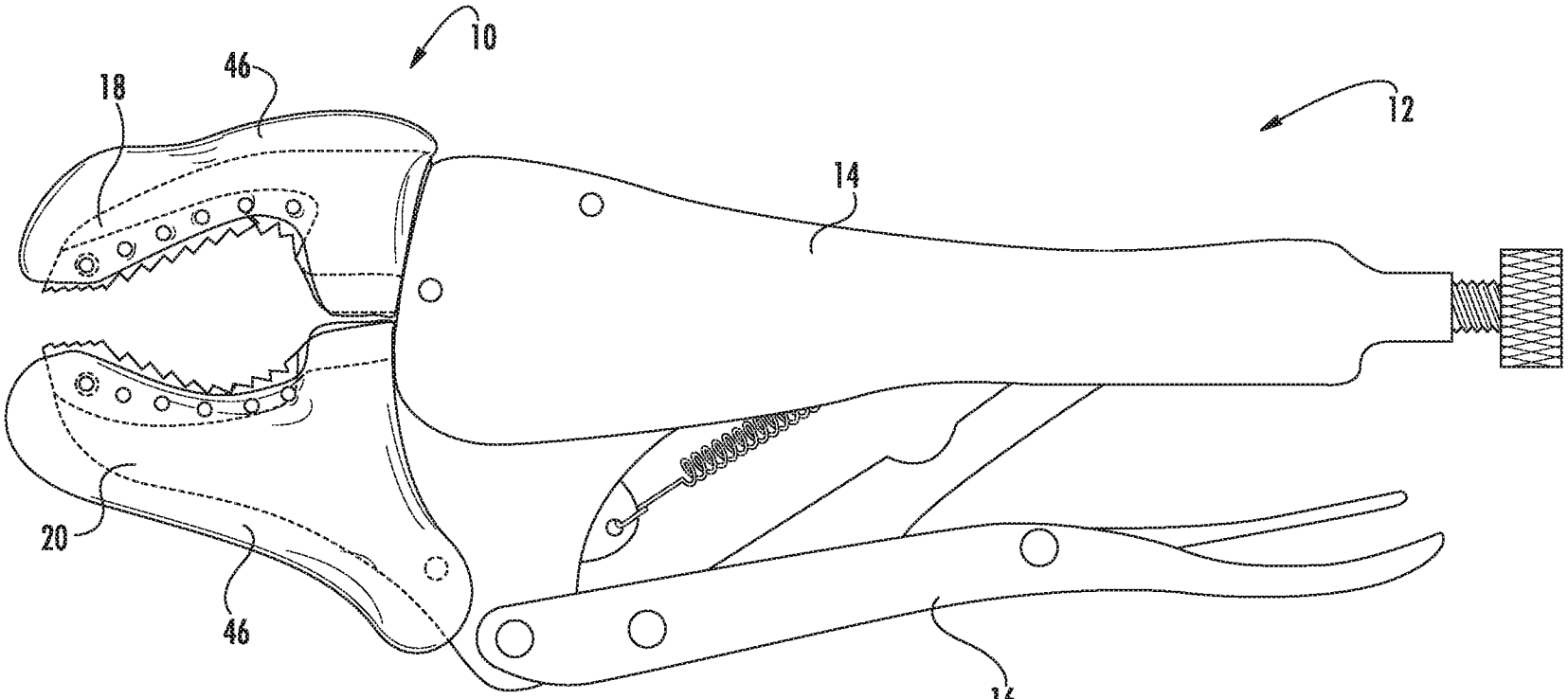
FIG. 6 is a side elevation view of an adjustable wrench including another embodiment of the restraint apparatus constructed in accordance with the present disclosure.

Another embodiment of the present disclosure is shown in FIG. 6. The restraint apparatus 10 in this embodiment is an enclosure device 46, such as a bag or sock, which could be attached to a portion of the handles 14, 16 and/or the first jaw 18 or the second jaw 20 of the wrench 12. It should be understood and appreciated that the first and second gripping surfaces 22 and 26 of the first jaw 18 or the second jaw 20 still remain exposed. It is contemplated that the enclosure device 46 can be constructed of any material capable of preventing the broken piece of the wrench 12 from injuring someone. The enclosure device 46 can be attached to the handles 14, 16 and/or the first jaw 18 or the second jaw 20 of the wrench 12 via any suitable manner known in the art. Examples include, but are not limited to, adhesive material, shrink wrap, metal rings, crimped metal, fasteners, Velcro®, magnets, braze, and the like.

Figure 7A:
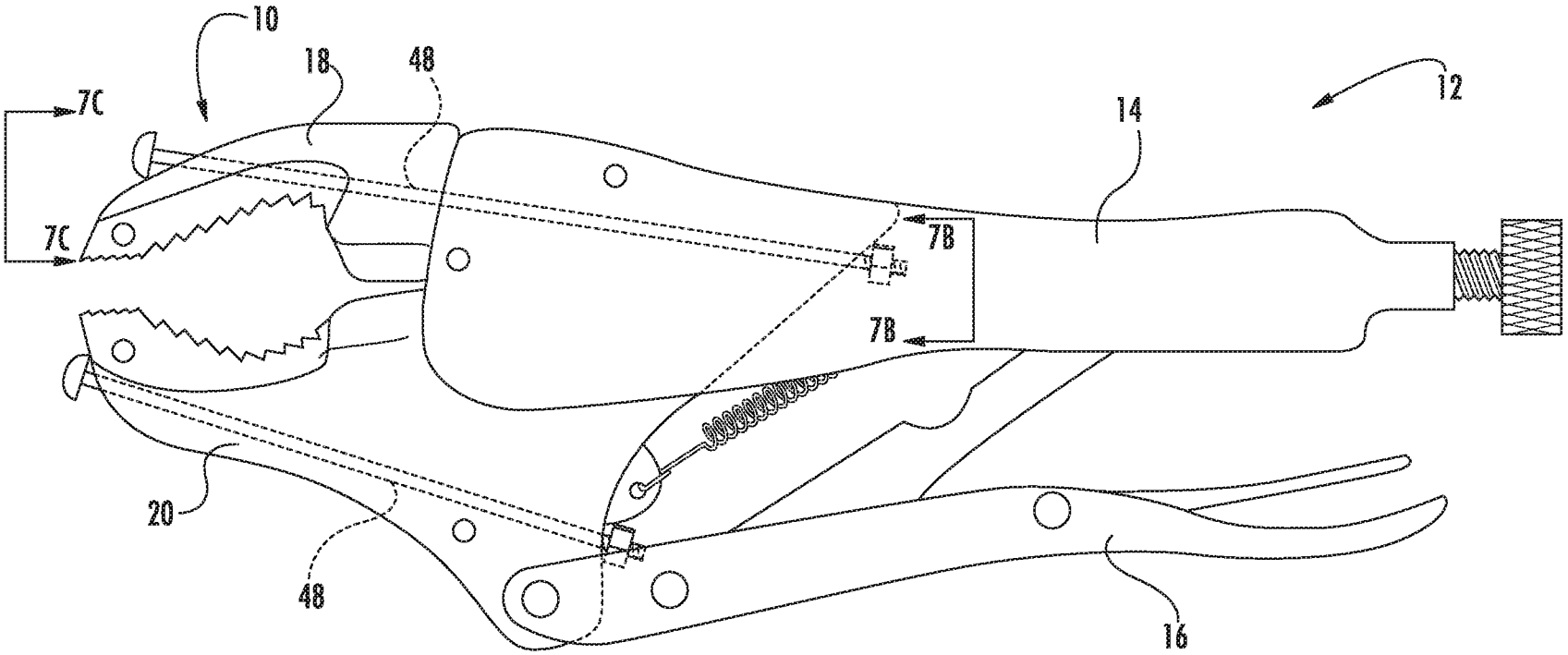
FIG. 7A is a side elevation view of an adjustable wrench including another embodiment of the restraint apparatus constructed in accordance with the present disclosure.
Figure 7B:
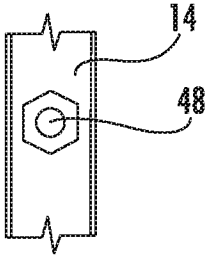
FIGS. 7B and 7C are particular views of the adjustable wrench and restraint apparatus shown in FIG. 7A.
Figure 7C:
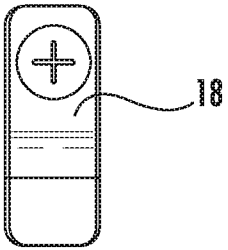

In yet another embodiment of the present disclosure and shown in FIG. 7, the restraint apparatus 10 can be a rod element 48 (such as a bolt or rivet) that extends through the first jaw 18 and/or the second jaw 20. The rod element 48 can be made of any material capable of preventing the fractured piece of the wrench 12, such as a soft metal, plastic, steel, or some other polymeric material.

Figure 8:
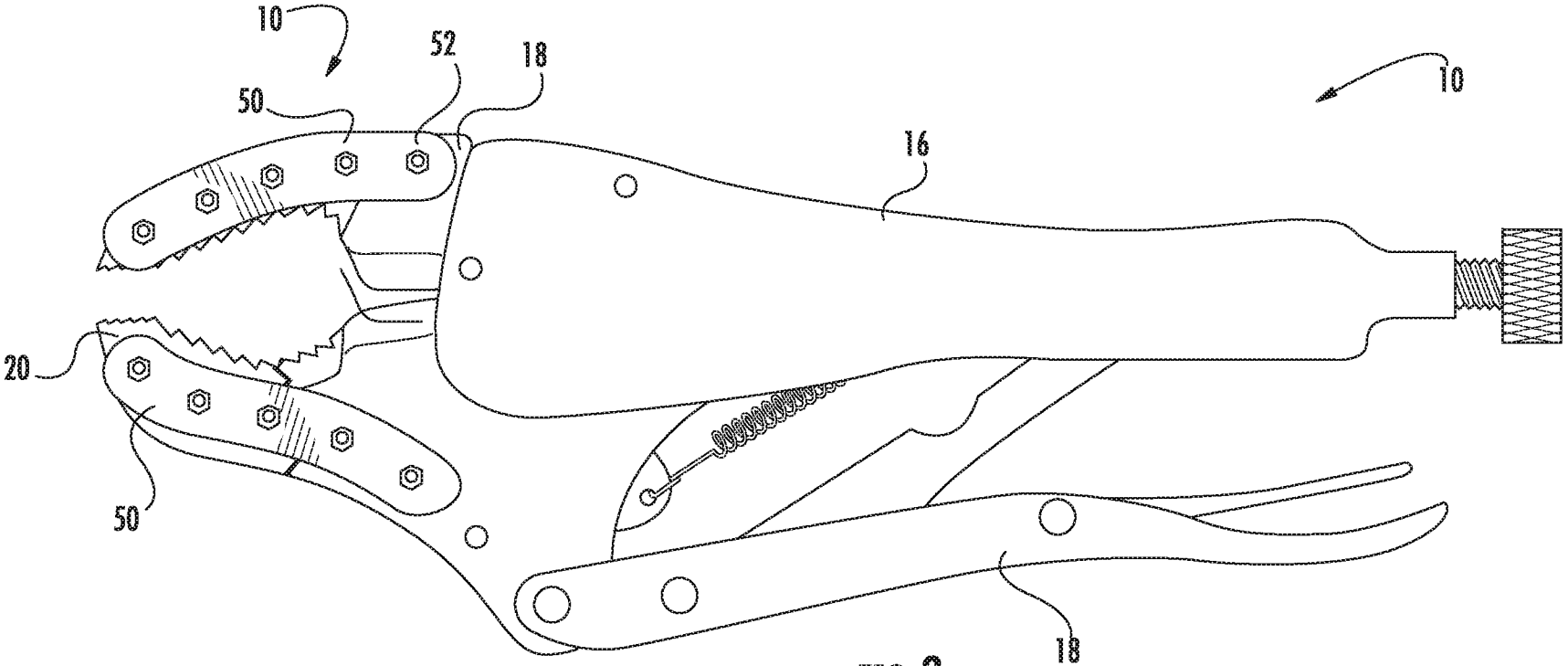
FIG. 8 is a side elevation view of an adjustable wrench including another embodiment of the restraint apparatus constructed in accordance with the present disclosure.

In another embodiment shown in FIG. 8, the restraint apparatus 10 can be a shaped plate 50 (such as a C-shaped plate or an S-shaped plate) attached to the first jaw 18 or the second jaw 20. In another embodiment, a portion 52 of the shaped plate 50 can also be attached to a portion of the first handle 14 of the wrench 12. The shaped plate 50 can be secured to the first jaw 18 or the second jaw 20 and/or the first handle 14 in any manner known in the art. Examples include, but are not limited to, welded, bolted, or any other way described herein.

Figure 9A:
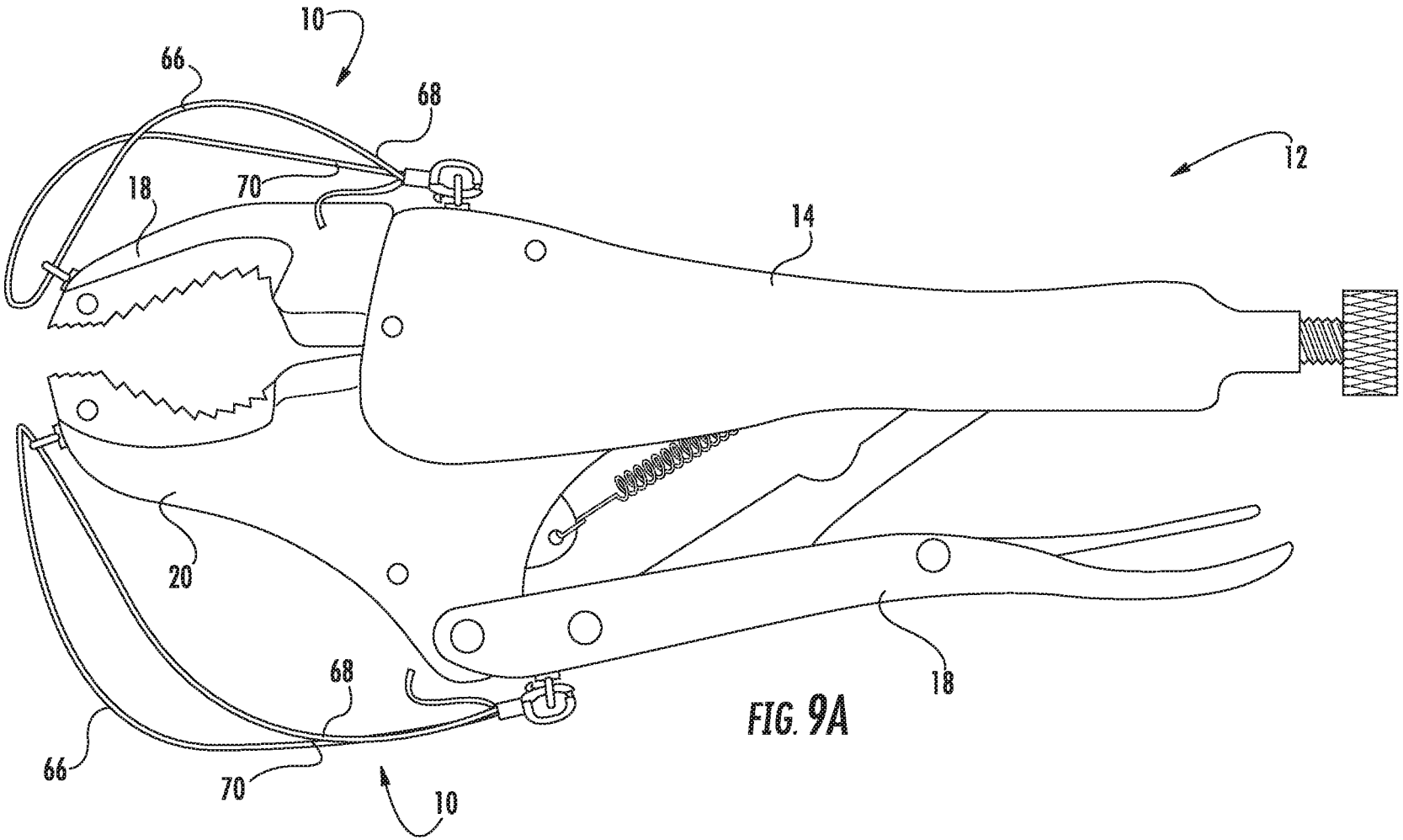
FIGS. 9A and 9B are side elevation views of an adjustable wrench including further embodiments of the restraint apparatus constructed in accordance with the present disclosure.
Figure 9B:
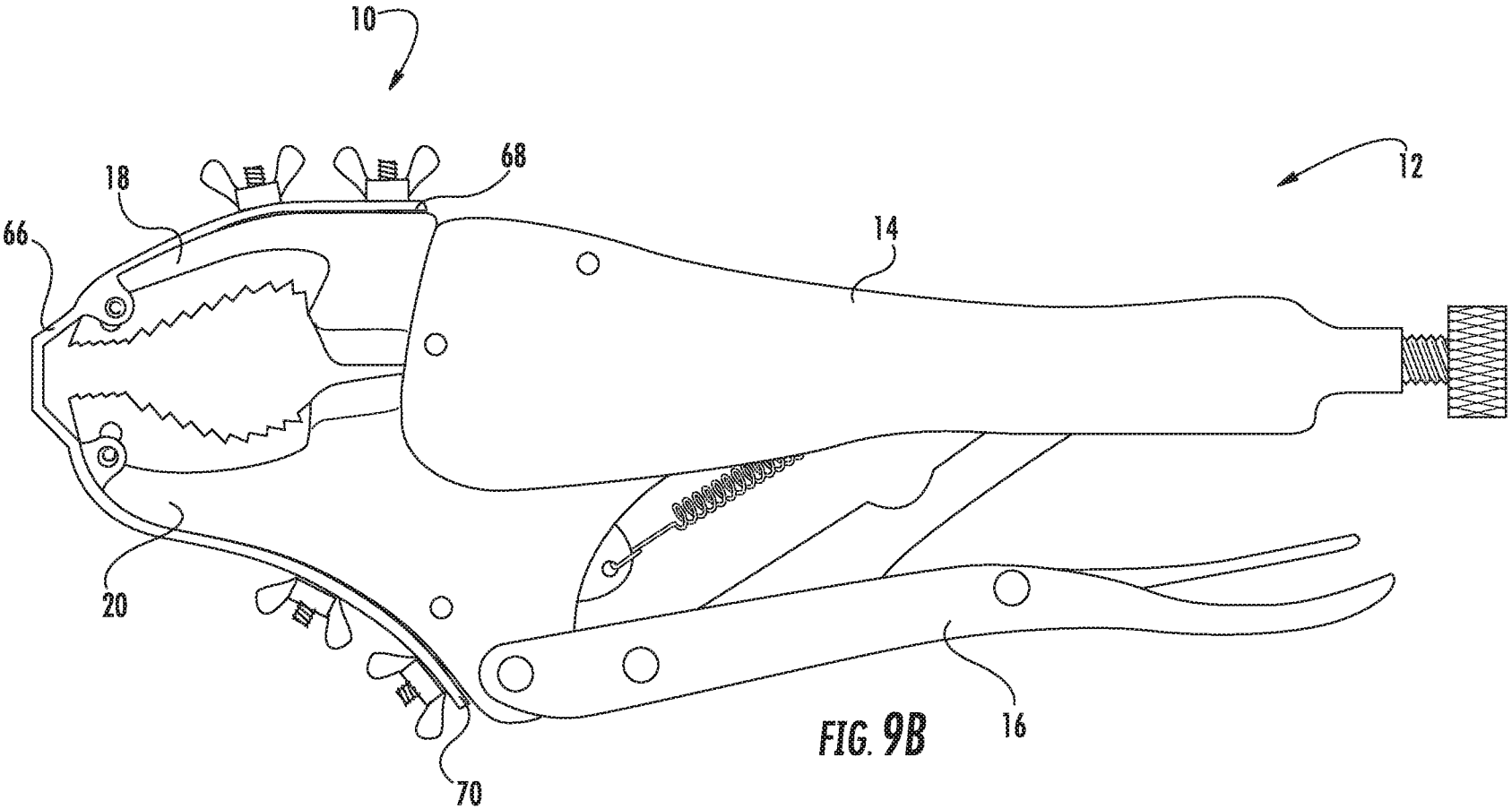

In yet another embodiment of the present disclosure, shown in FIGS. 9A and 9B, the restraint apparatus 10 includes a lanyard device 66 attached to a portion of the first jaw 18 or the second jaw 20 and any other portion of the wrench 12 on the other side of where the first jaw 18 or the second jaw 20 typically fractures. The lanyard device 66 can also be attached to the work object the wrench 12 is engaging, or any other nearby piece of equipment (not shown). In another embodiment, the lanyard device 66 can be set up to extend from the first jaw 18, around the work object and be attached to another portion of the wrench 12, such as the second jaw 20 or handles 14, 16. The lanyard device 66 may also be attached to another wrench (not shown) that is being used in tandem with the wrench 12. Each end 68 and 70 of the lanyard device 66 can be attached via any attachment method known in the art, releasably attached or securely attached. Examples of attachment methods include, but are not limited to, adhesive material, shrink wrap, metal rings, crimped metal, fasteners, Velcro®, magnets, braze, and the like.

Figures 10A, 10B:
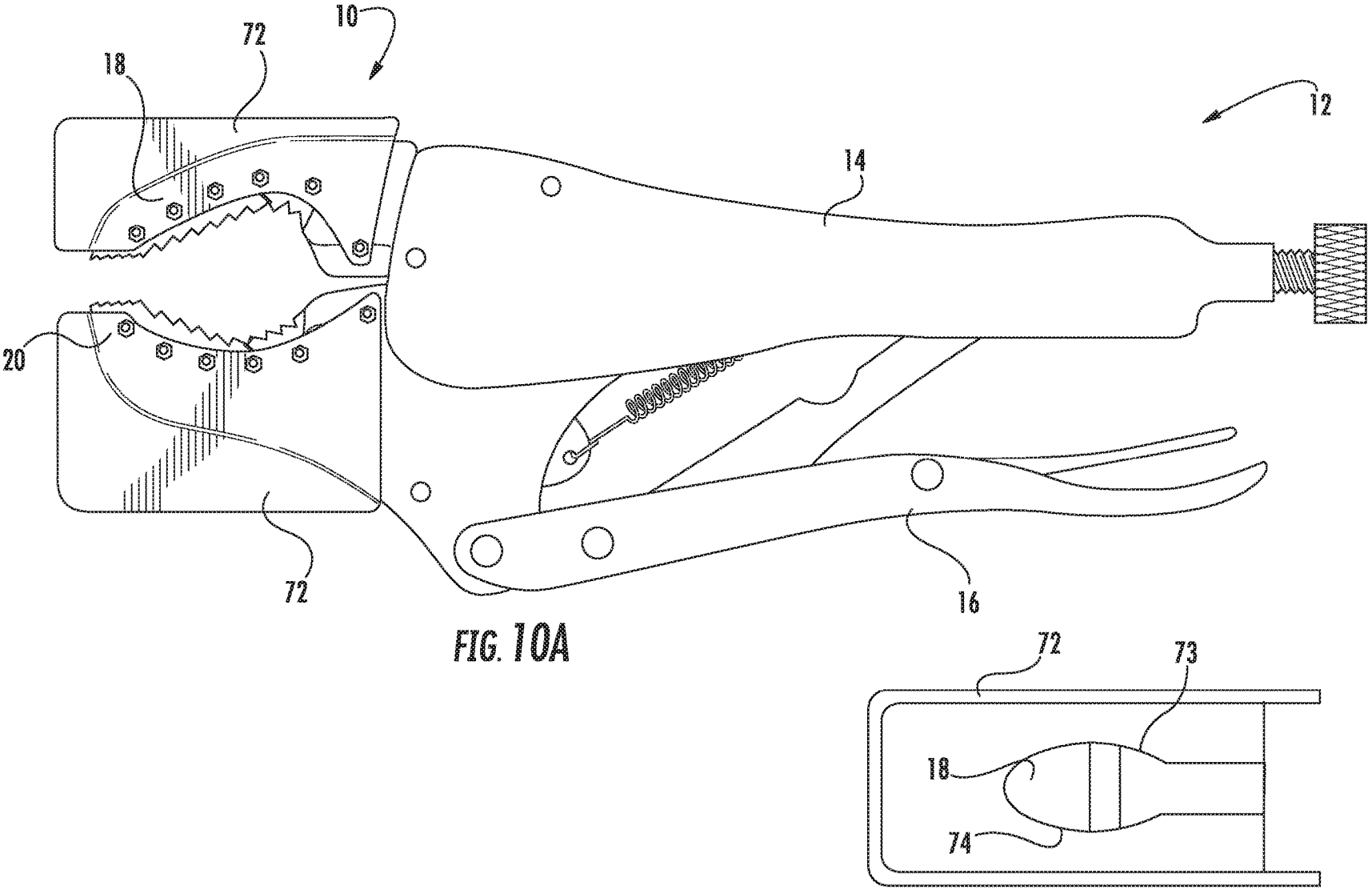
FIG. 10A is a side elevation view of an adjustable wrench including another embodiment of the restraint apparatus constructed in accordance with the present disclosure.
FIG. 10B is a particular view of the adjustable wrench and restraint apparatus shown in FIG. 10A.

In another embodiment of the present disclosure, shown in FIGS. 10A and 10B, the restraint apparatus 10 includes an elastic tension member 72. A portion of the elastic tension member 72 extends from a first side 73 of the first jaw 18 to a second side 74 of the first jaw 18 and encapsulates a majority of the first jaw 18 to severely limit the movement of the fractured piece of the wrench 12. In one embodiment, the elastic tension member 72 can also be secured to a portion of the first handle 14. The elastic tension member 72 can be secured to the first jaw 18 or the first handle 14 via any manner known in the art. Furthermore, another elastic tension member 72 can be secured to the second handle 16 and/or the second jaw 20 in a similar fashion to the first handle 14 and the first jaw 18. Examples of securing methods include, but are not limited to, adhesive material, shrink wrap, metal rings, crimped metal, fasteners, Velcro®, magnets, braze, and the like.

Figure 11:
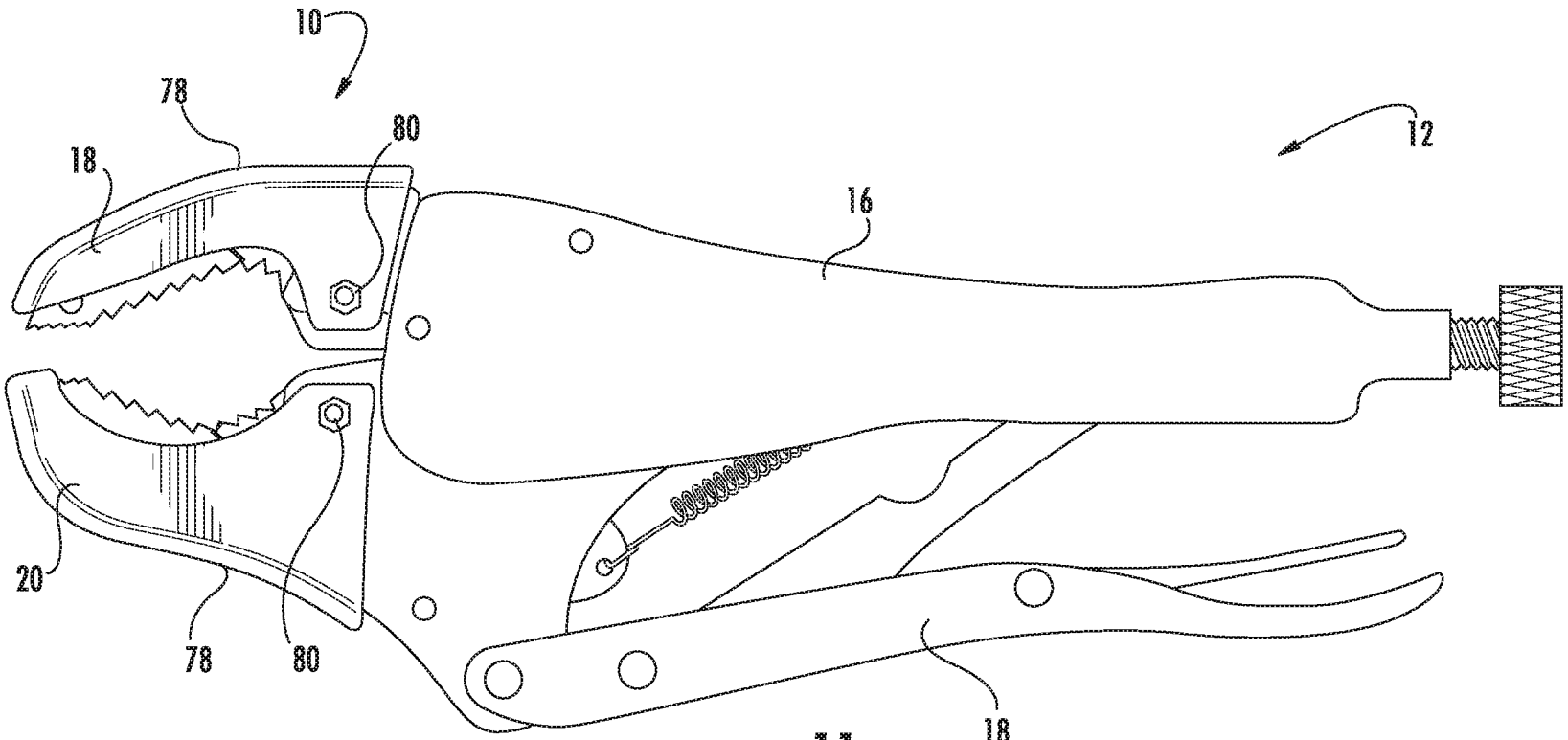
FIG. 11 is a side elevation view of an adjustable wrench including another embodiment of the restraint apparatus constructed in accordance with the present disclosure.
Figure 12:
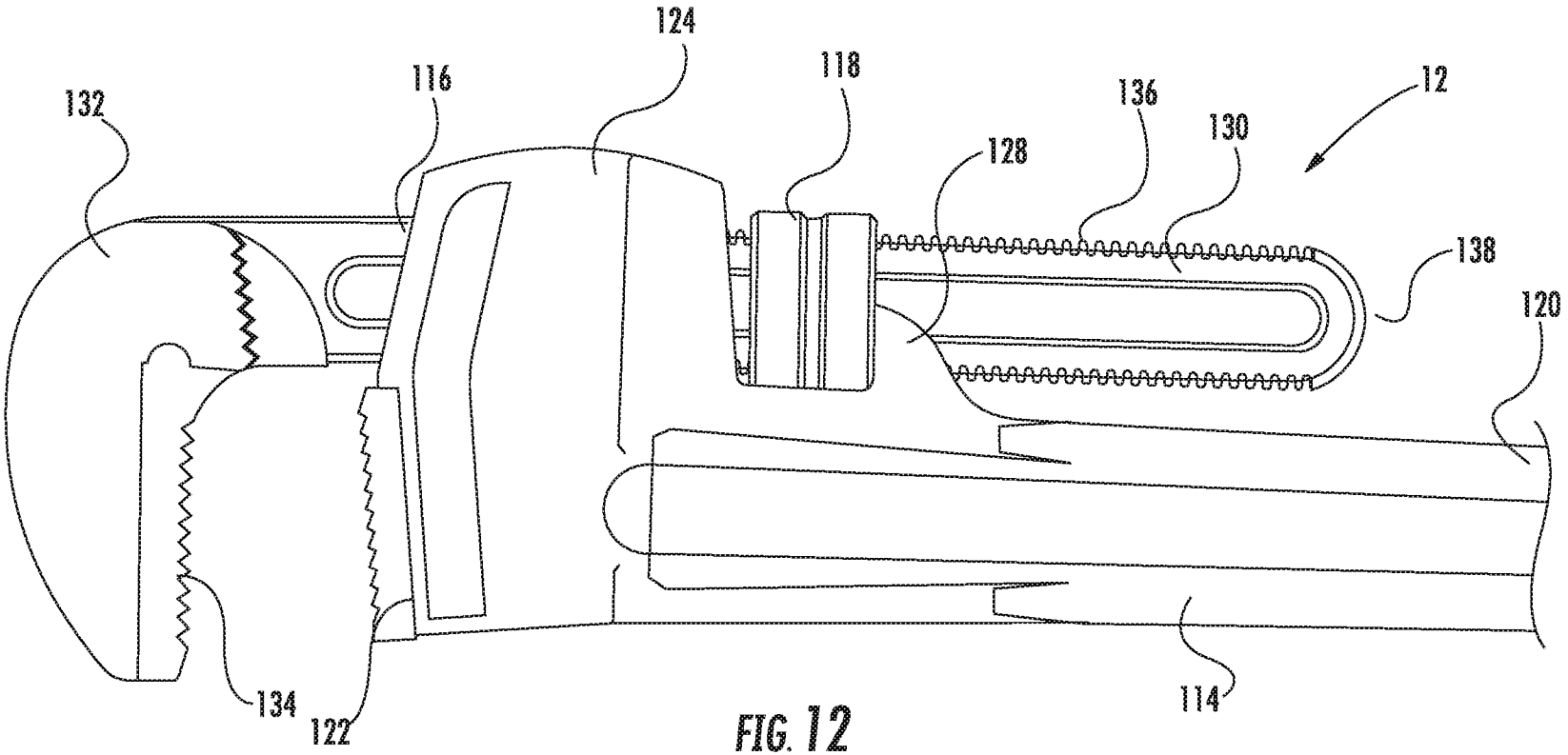
FIG. 12 is a side elevation view of an adjustable wrench.

In yet another embodiment of the present disclosure shown in FIG. 11, the restraint apparatus 10 includes a shroud 78 attached to a portion of the first jaw 18 or the second jaw 20, which encapsulates a portion of the first jaw 18 or the second jaw 20. The shroud 78 may be attached to the first jaw 18 or the second jaw 20 via any securing device 80, such as a bolt or screw. The shroud 78 may also be attached to the first jaw 18 or the second jaw 20 via any manner known in the art. Examples of attachment methods include, but are not limited to, adhesive material, shrink wrap, metal rings, crimped metal, fasteners, Velcro®, magnets, braze, and the like.

In a further embodiment and shown in FIGS. 12-24, the adjustable wrench 12 can be a pipe wrench that typically includes a handle 114, an L-shaped movable jaw 116 and an adjustment nut 118 for positioning the L-shaped movable jaw 116 (or hook jaw) respective of the handle 114. The handle 114 has a handle end 120, a flat serrated jaw surface 122 for engaging the work object, and a first projection 124 disposed on the handle 114 adjacent to the flat serrated jaw surface 122. The first projection 124 includes an adaptively-sized tunnel 126 disposed therethrough. The handle 114 can also include a second projection 128 disposed on the handle 114 that cooperates with the first projection 124 to hold and maintain the adjustment nut 118 therebetween.

The L-shaped movable jaw 116 has a lever arm 130, a hook portion 132 and a serrated jaw 134 for further engagement of the work object. The lever arm 130 includes threads 136 that engage the adjustment nut 118 and a terminal end 138 disposed at the opposite end of the L-shaped movable jaw 116 from the serrated jaw 134. Furthermore, the lever arm 130 of the L-shaped movable jaw 116 can be positioned within the tunnel 126 of the first projection 124 of the handle 114. The second projection 128 of the handle 114 is sized such that it does not interfere with the lever arm 130 of the L-shaped movable jaw 116 as it extends through the tunnel 126. The hook portion 132 is the part of the adjustable wrench 12 most likely to fracture when the wrench 12 is subjected to forces beyond its structural limit.

In various embodiments shown in FIGS. 13-24, the wrench 12 can also include the restraint apparatus 10 wherein the restraint apparatus 10 can take on numerous forms. The restraint apparatus 10 can be any device attachable to any portion of the wrench 12 that limits the displacement between a broken portion of the wrench 12 and any other portion of the wrench 12. In most scenarios, the hook portion 132 is the part of the wrench 12 that fails, thus the relative displacement between the broken portion of the hook portion 132 and any other part of the wrench 12 is limited when the hook portion 132 fails. The relative displacement between the broken portion of the hook portion 132 is also limited between the broken portion of the hook portion 132 and the handle 114, the remaining portion of the hook portion 132, the adjustment nut 118, or the work object.

Figure 13:
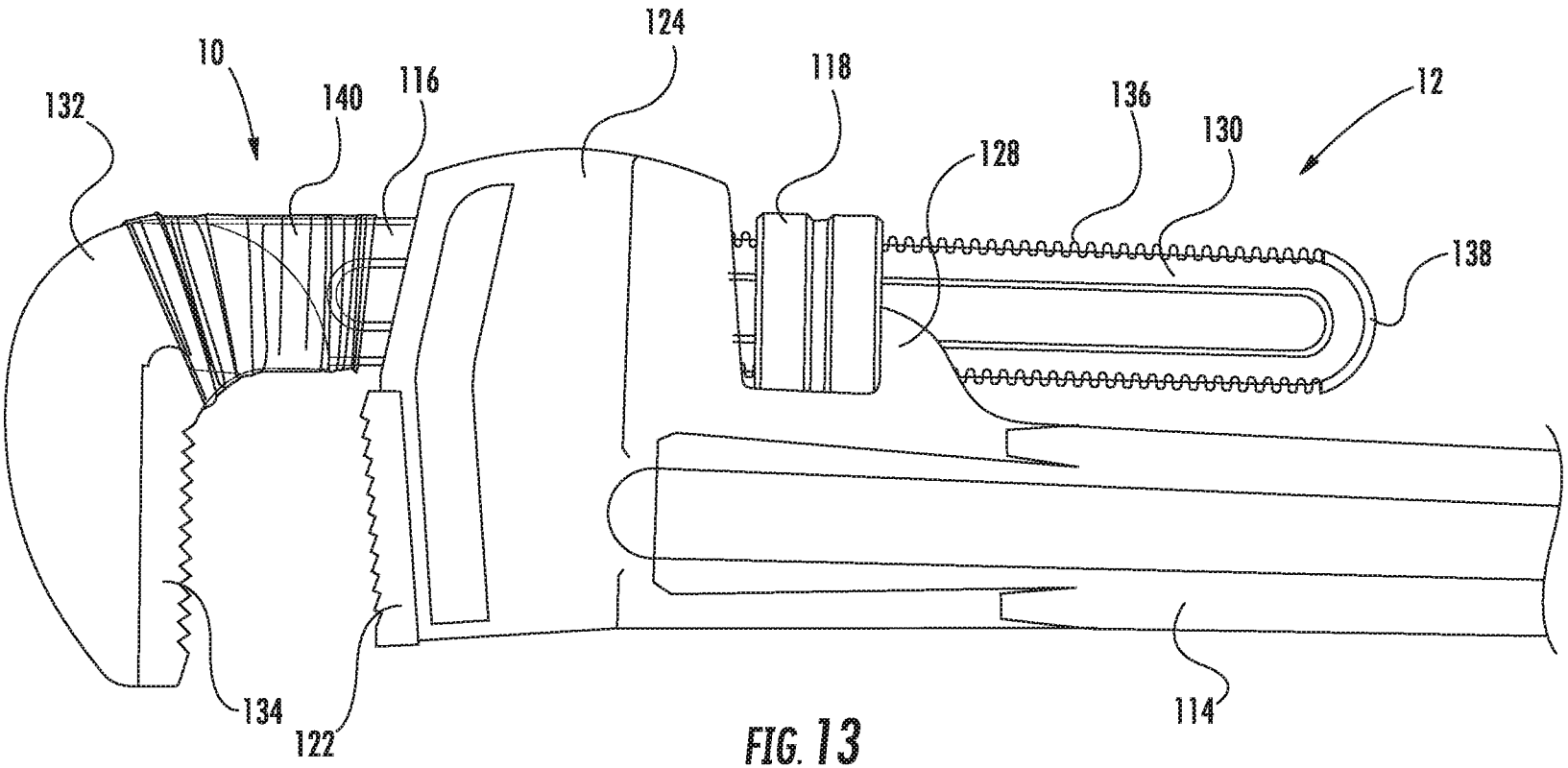
FIG. 13 is a side elevation view of an adjustable wrench including a restraint apparatus constructed in accordance with the present disclosure.
Figure 14:
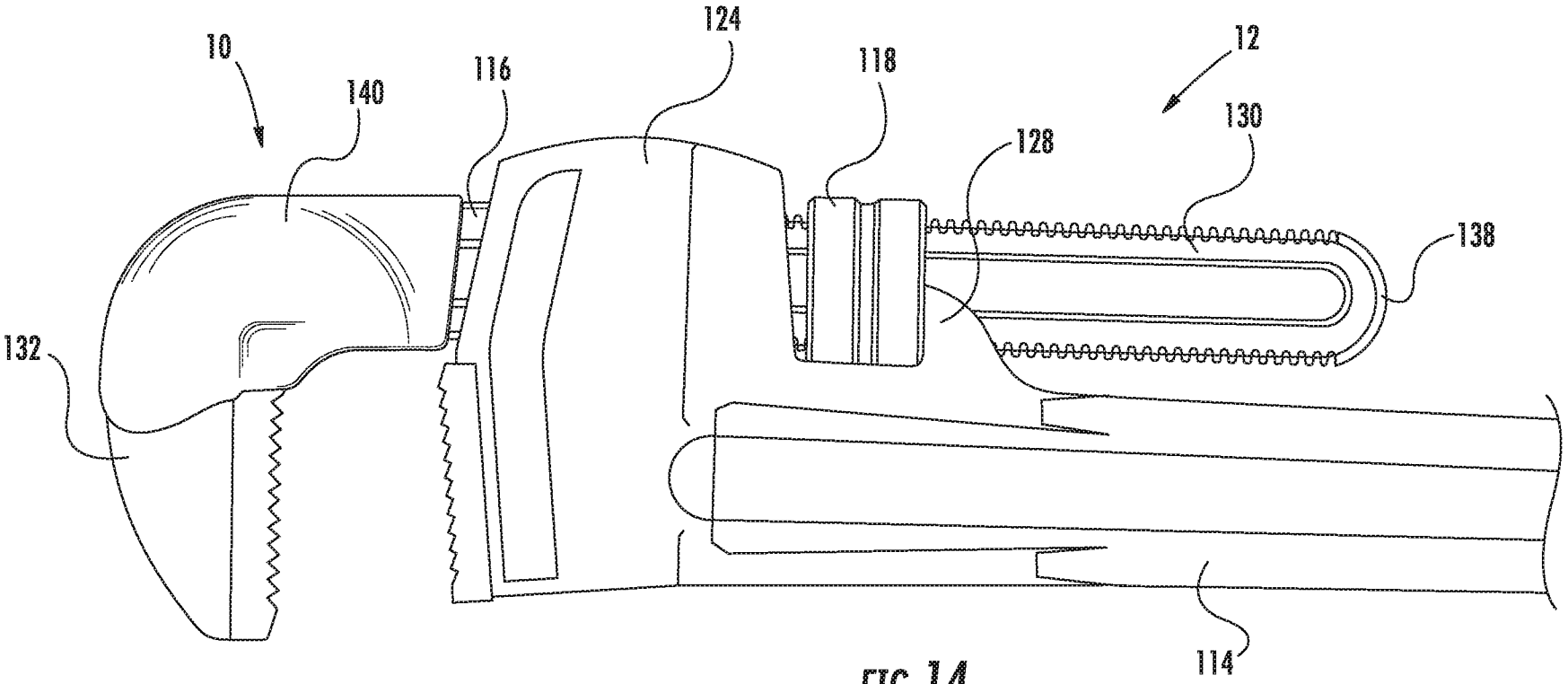
FIG. 14 is a side elevation view of an adjustable wrench including another embodiment of the restraint apparatus constructed in accordance with the present disclosure.
Figure 15:
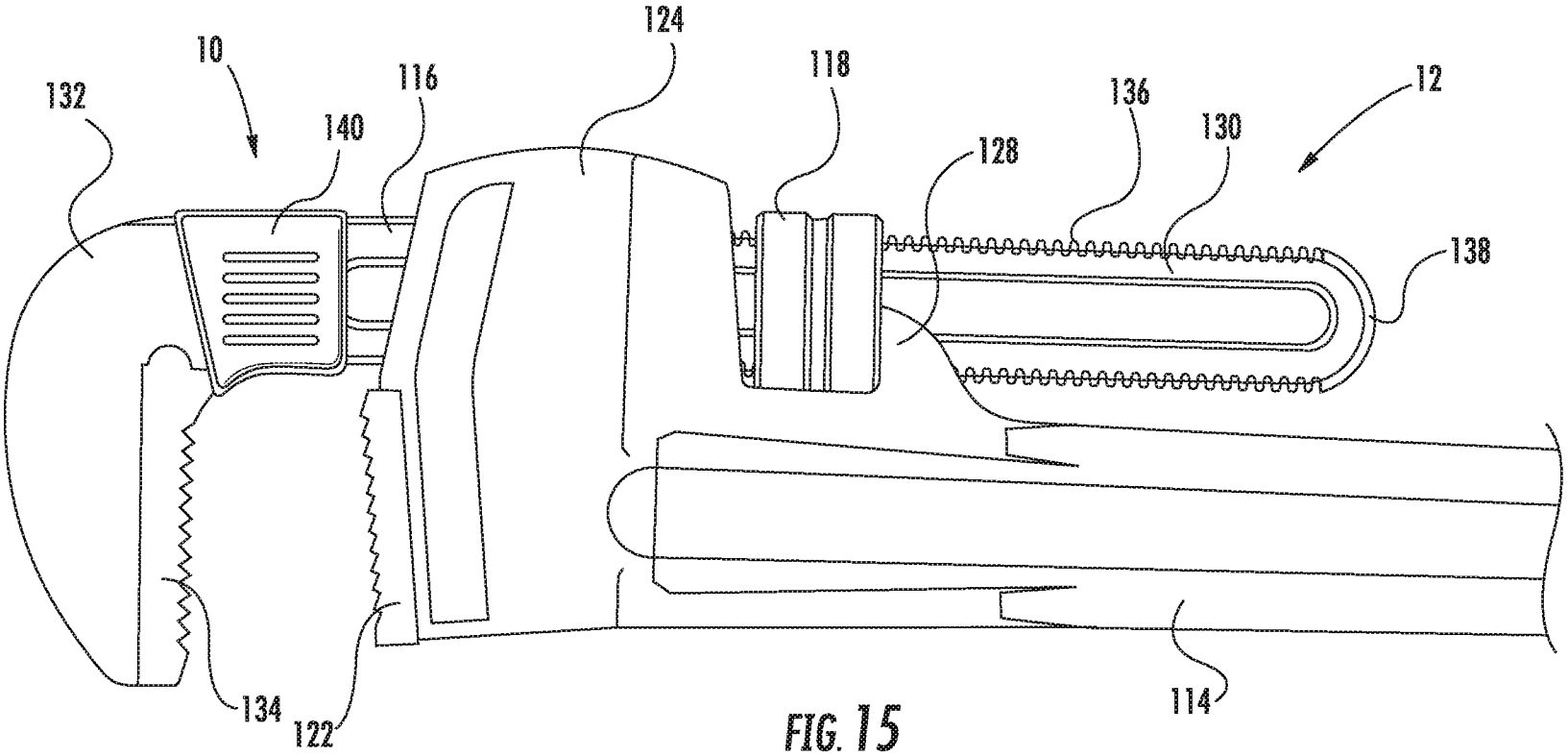
FIG. 15 is a side elevation view of an adjustable wrench including another embodiment of the restraint apparatus constructed in accordance with the present disclosure.

More specifically and shown in FIGS. 13-15, the restraint apparatus 10 includes at least one layer of material 140 to cover a portion of the hook portion 132. The layer of material 140 works to retain any portion of the hook portion 132 that may fracture off or substantially reduce the velocity of the fractured portion of the hook portion 132. The layer of material 140 may cover the entire L-shaped movable jaw 116 or the hook portion 132 except for teeth 142 disposed on the serrated jaw 134 of the L-shaped movable jaw 116.

In the embodiments shown in FIGS. 13-15, the at least one layer of material 140 can be a shrink wrap material, tape, plastic, rubber, polymeric material, elastomeric material, a metallic material, a metal, a combination thereof, or any other material known in the art capable of restraining, collecting, or limiting the movement of any fractured pieces of the wrench 12. The at least one layer of material 140 can be coated on the hook portion 132 and/or held in place on the L-shaped movable jaw 116 via any manner known in the art. Examples include, but are not limited to, adhesive material, shrink wrap, metal rings, crimped metal, fasteners, Velcro®, magnets, braze, and the like.

In another embodiment, the metal can be formed and fastened to portions of the hook portion 132 of the L-shaped movable jaw 116. The metal may be positioned on one or both sides of the hook portion 132 or it may be positioned such that it bends around the hook portion 132 of the L-shaped movable jaw 116. The metal may also be covered with rubber, plastic, heat shrink tubing, tape, an elastomeric material, a polymeric material, or any other common fastening means.

Figure 16A:
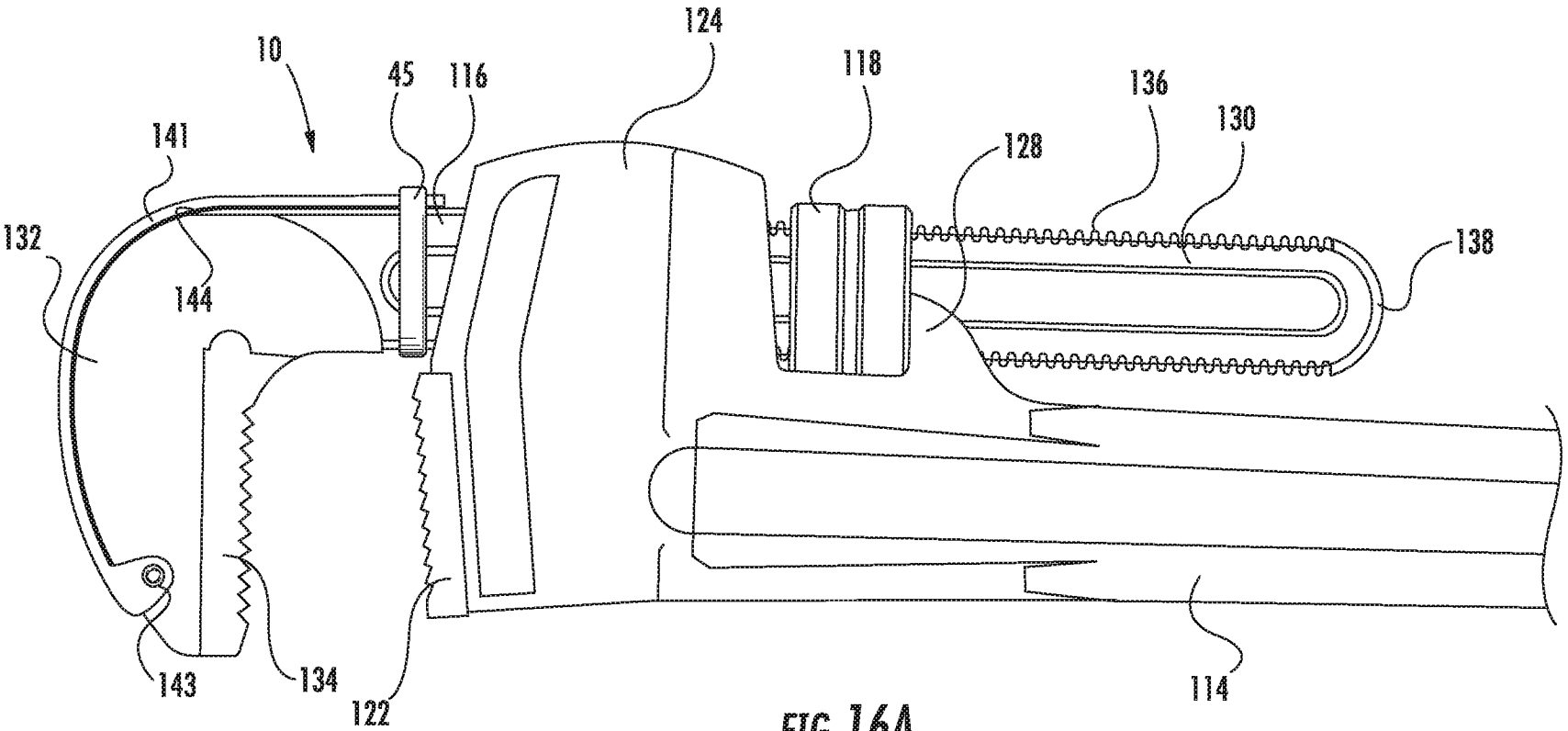
FIGS. 16A and 16B are side elevation views of an adjustable wrench including further embodiments of the restraint apparatus constructed in accordance with the present disclosure.
Figure 16B:
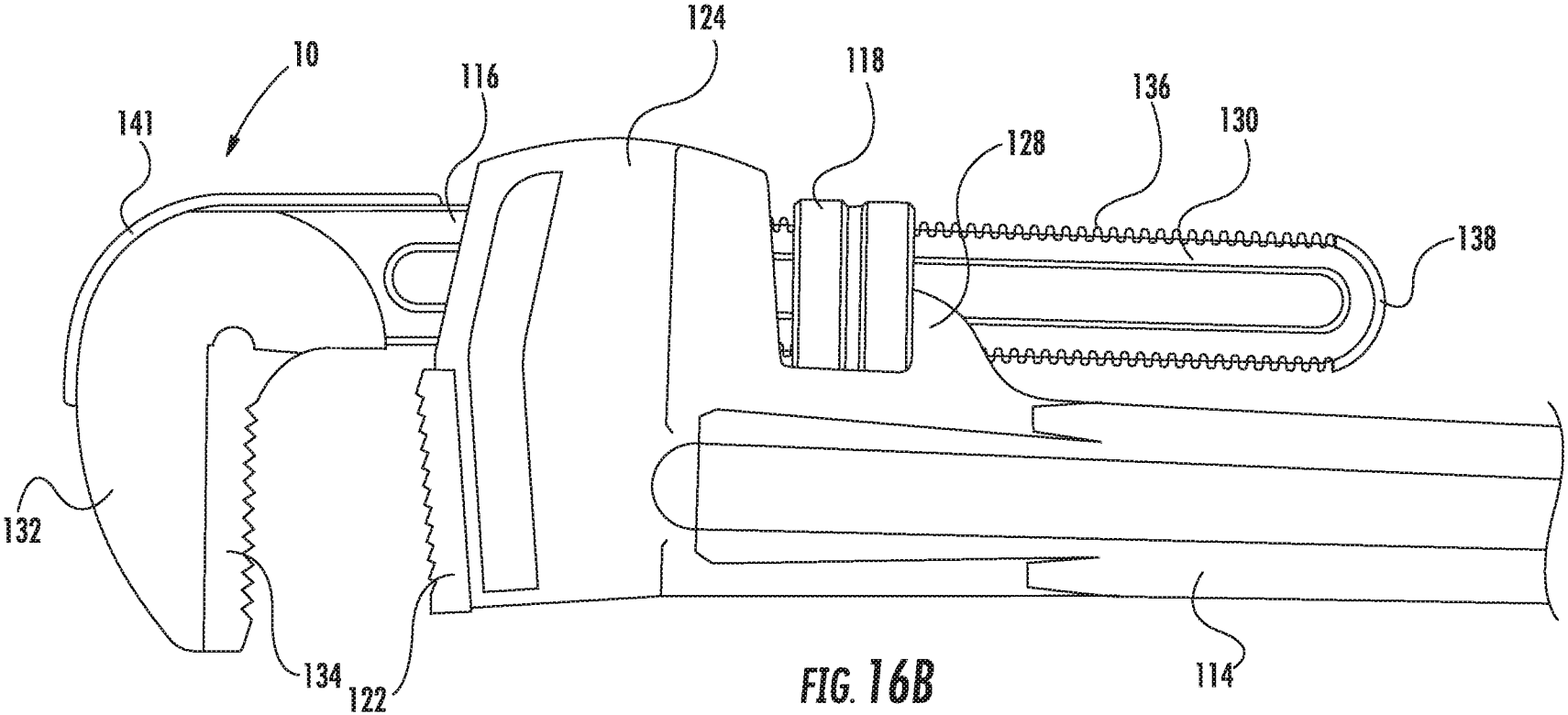

In another embodiment of the present disclosure, shown in FIGS. 16A and 16B, the restraint apparatus 10 is a strip of material 141, such as metal strip, wire, braze, Kevlar® fiber or film, or weld string disposed on the outer portion 144 (or compression-accepting side) of the hook portion 132 which extends across the typical fracture area of the L-shaped movable jaw 116. The strip of material 141 may have elastic properties and be fastened to the hook portion 132 via any manner known in the art. Examples include, but are not limited to, glue, rivets, adhesive material, shrink wrap, metal rings, crimped metal, fasteners, Velcro®, magnets, braze, and the like. The strip of material 141 can be elastomeric and/or metallic material. In one embodiment shown in FIG. 16A, the strip of material 141 is secured to the hook portion 132 via a rivet 143 and a ring of material 145.

Figure 17:
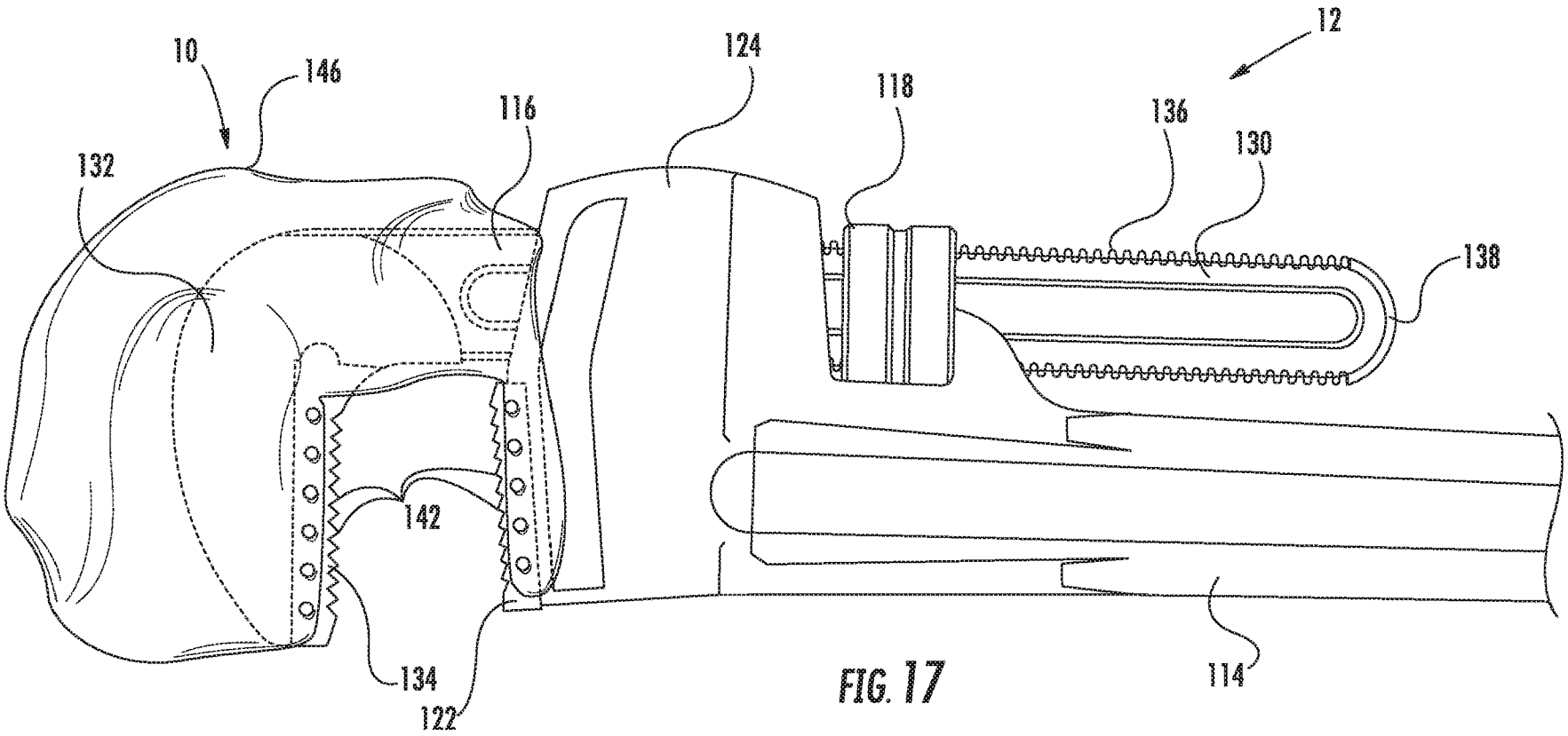
FIG. 17 is a side elevation view of an adjustable wrench including another embodiment of the restraint apparatus constructed in accordance with the present disclosure.

Another embodiment of the present disclosure is shown in FIG. 17. The restraint apparatus 10 in this embodiment is an enclosure device 146, such as a bag or sock, which could be attached to a portion of the handle 114 and/or the L-shaped movable jaw 116 of the wrench 12. It should be understood and appreciated that the teeth 142 of the serrated jaw 134 of the L-shaped movable jaw 116 still remain exposed. It is contemplated that the enclosure device 146 can be constructed of any material capable of preventing the broken piece of the wrench 12 from injuring someone. The enclosure device 146 can be attached to the handle 114 or the L-shaped movable jaw 116 via any suitable manner known in the art. Examples include, but are not limited, to adhesive material, shrink wrap, metal rings, crimped metal, fasteners, Velcro®, magnets, braze, and the like.

Figure 18A:
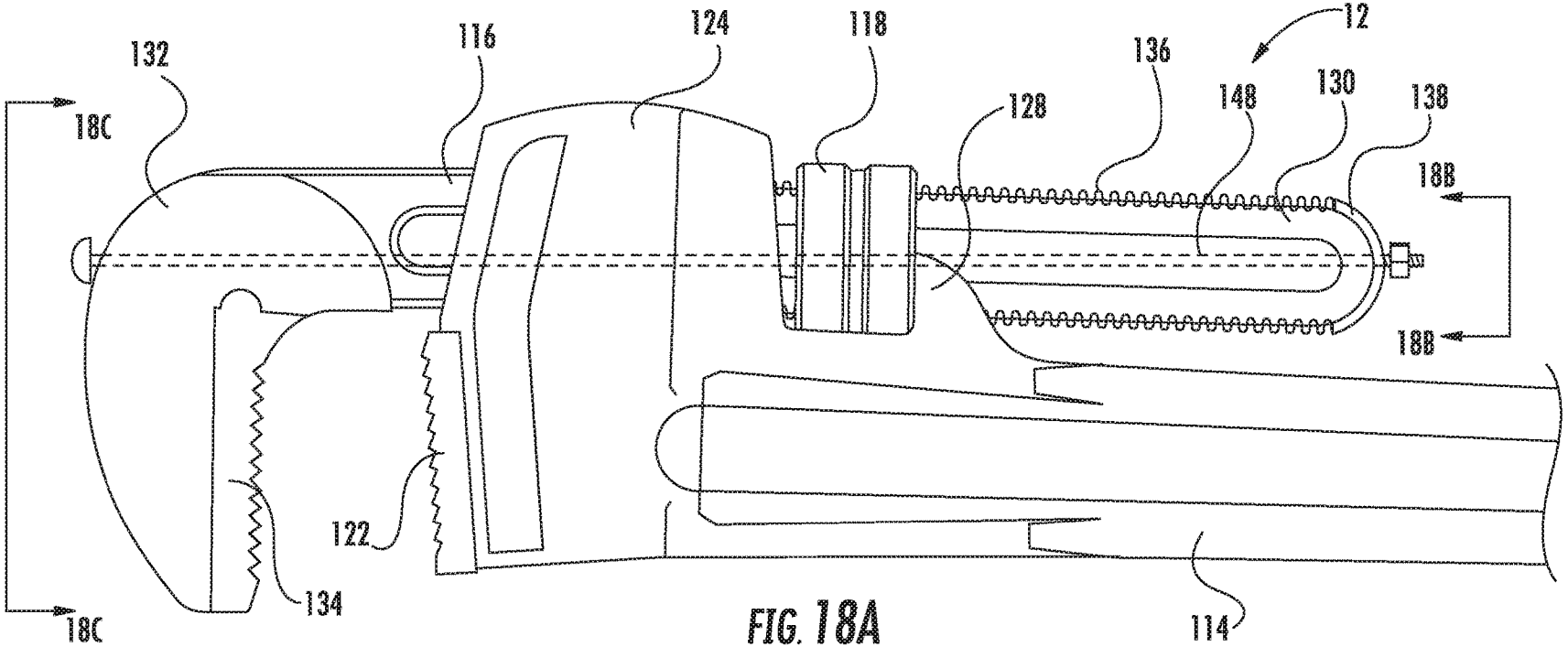
FIG. 18A is a side elevation view of an adjustable wrench including another embodiment of the restraint apparatus constructed in accordance with the present disclosure.
Figure 18B:
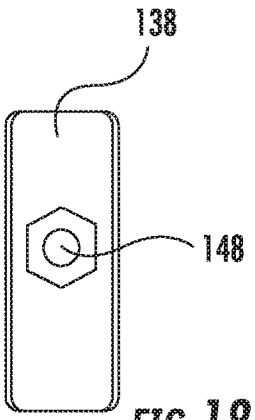
FIGS. 18B and 18C are particular views of the adjustable wrench and restraint apparatus shown in FIG. 7A.
Figure 18C:
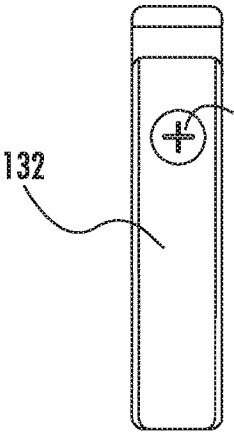
Figure 19:
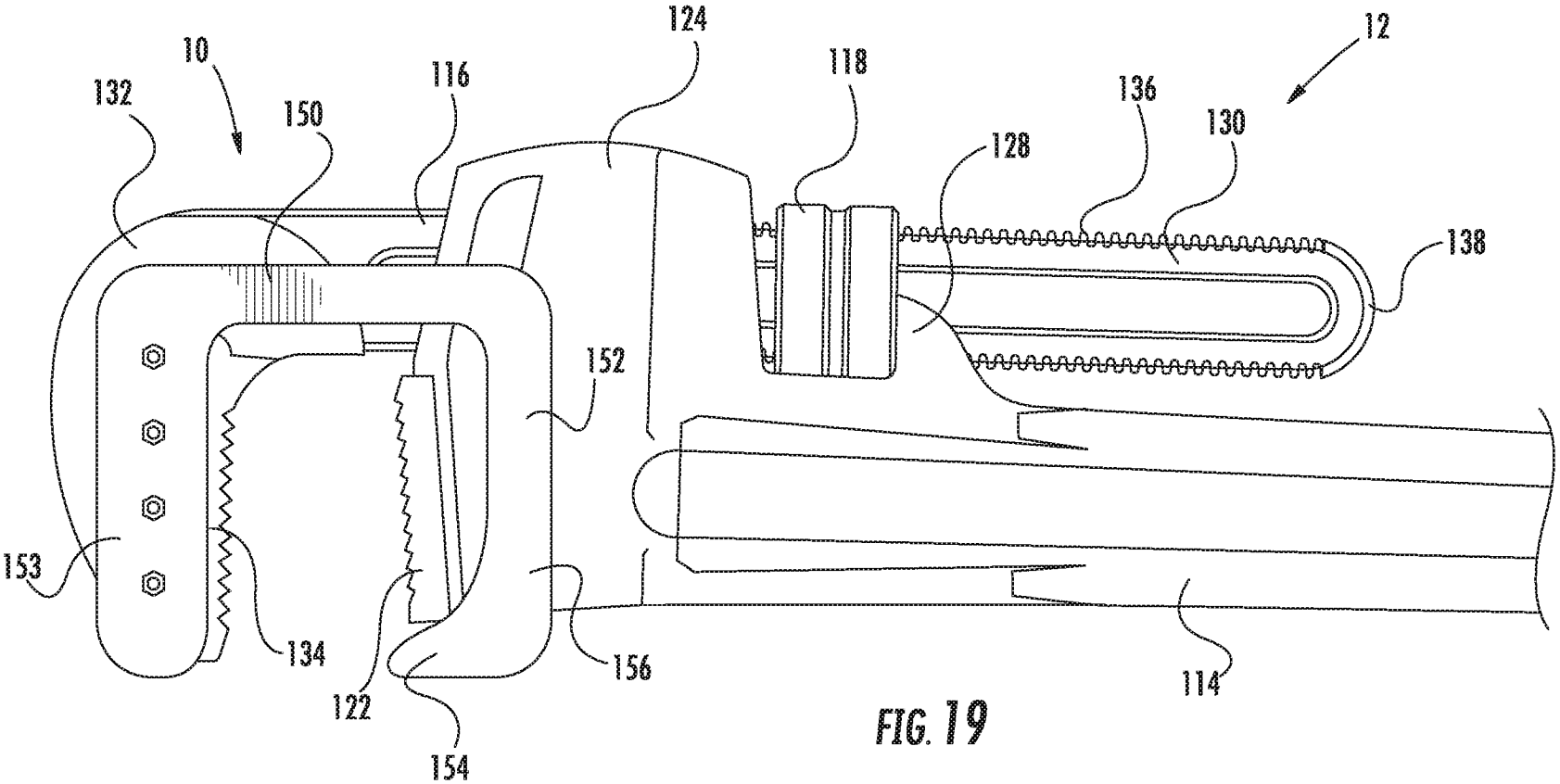
FIG. 19 is a side elevation view of an adjustable wrench including another embodiment of the restraint apparatus constructed in accordance with the present disclosure.

In yet another embodiment of the present disclosure and shown in FIGS. 18A-18C, the restraint apparatus 10 can be a rod element 148 (such as a bolt or rivet) that extends through the L-shaped movable jaw 116 and the lever arm 130 of the L-shaped movable jaw 116. The rod element 148 can be made of any material capable of preventing the fractured piece of the wrench 12, such as a soft metal, plastic, steel, plastic, or some other polymeric material.

In another embodiment shown in FIG. 18, the restraint apparatus 10 can be a C-shaped plate 150 attached to the L-shaped movable jaw 116. In another embodiment, a portion 152 of the C-shaped plate 150 can also be attached to a portion of the handle 114 of the wrench 12. The C-shaped plate 150 can be secured to the L-shaped movable jaw 116 and/or the handle 114 in any manner known in the art. Examples include, but are not limited to, welded, bolted, or any other way described herein. In a further embodiment, the C-shaped plate 150 can include a first end portion 153 and a lip portion 154 disposed on a second end portion 156 disposed on the handle 114 of the wrench 12 to hit the work object when/if the wrench 12 fractures.

Figure 24:
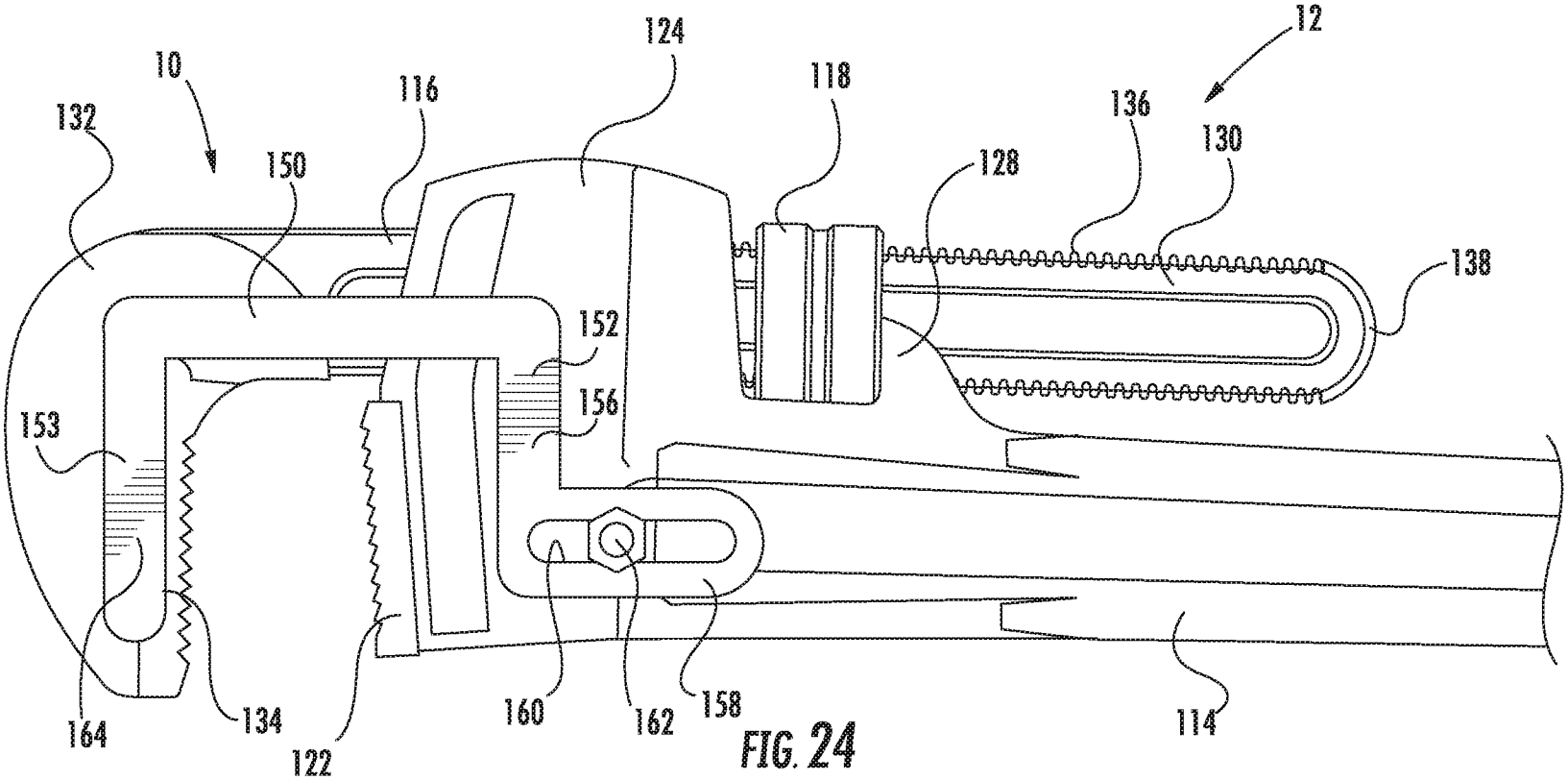
FIG. 24 is a side elevation view of an adjustable wrench including another embodiment of the restraint apparatus constructed in accordance with the present disclosure.

In yet another embodiment shown in FIG. 24, the C-shaped plate 150 includes an extension element 158 extending from the second end portion 156 with an elongated opening 160 (slide opening) disposed therein for receiving a pin element 162 attached to a side of the handle 114. In this embodiment, an upper part 164 of the C-shaped plate 150 is attached to the hook portion 132. The pin element 162 on the handle 114 and the elongated opening 160 in the extension element 158 of the C-shaped plate 150 cooperate to allow the L-shaped movable jaw 116 to extend and retract.

Figure 20A:
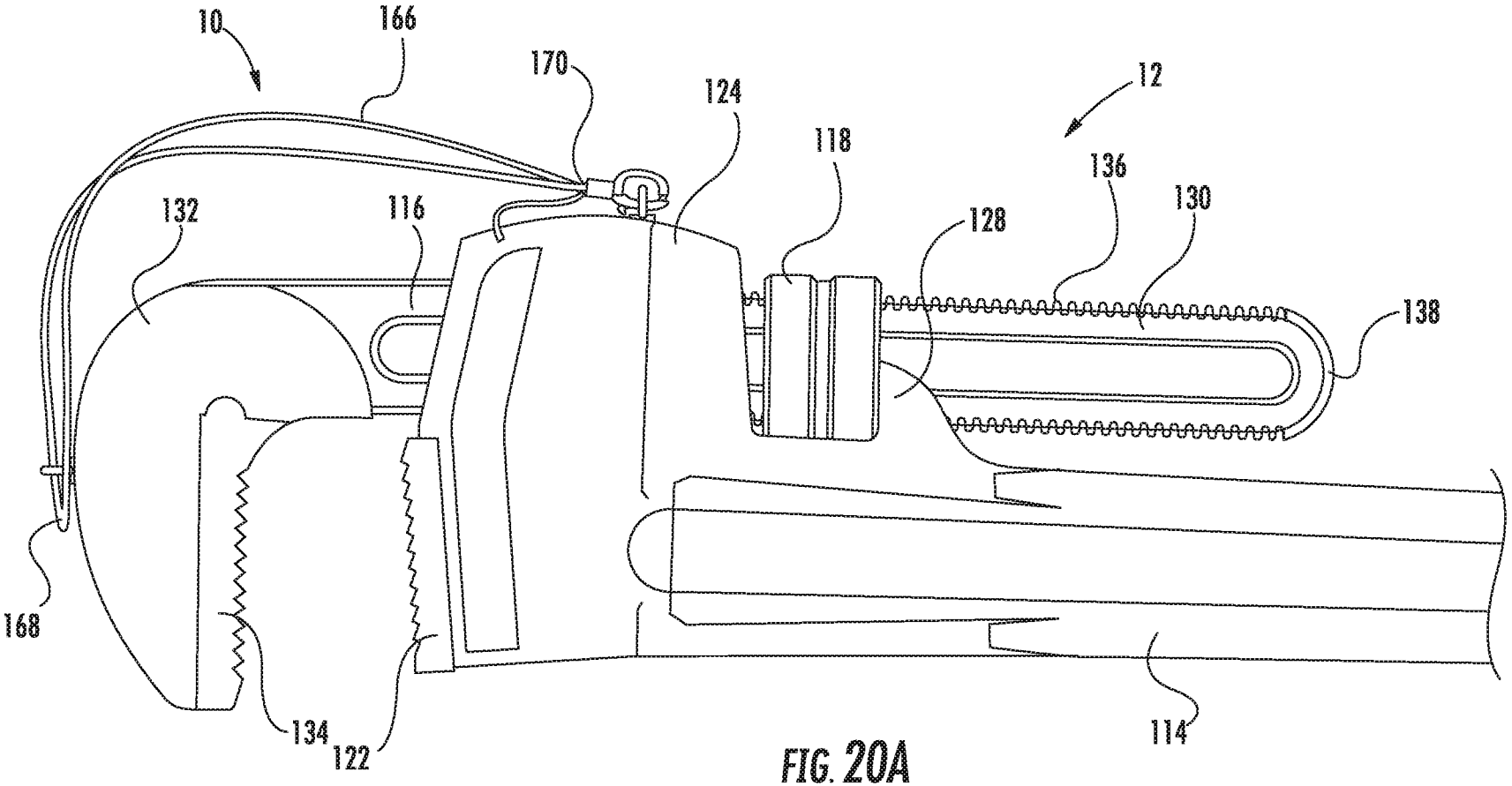
FIGS. 20A and 20B are side elevation views of an adjustable wrench including further embodiments of the restraint apparatus constructed in accordance with the present disclosure.
Figure 20B:
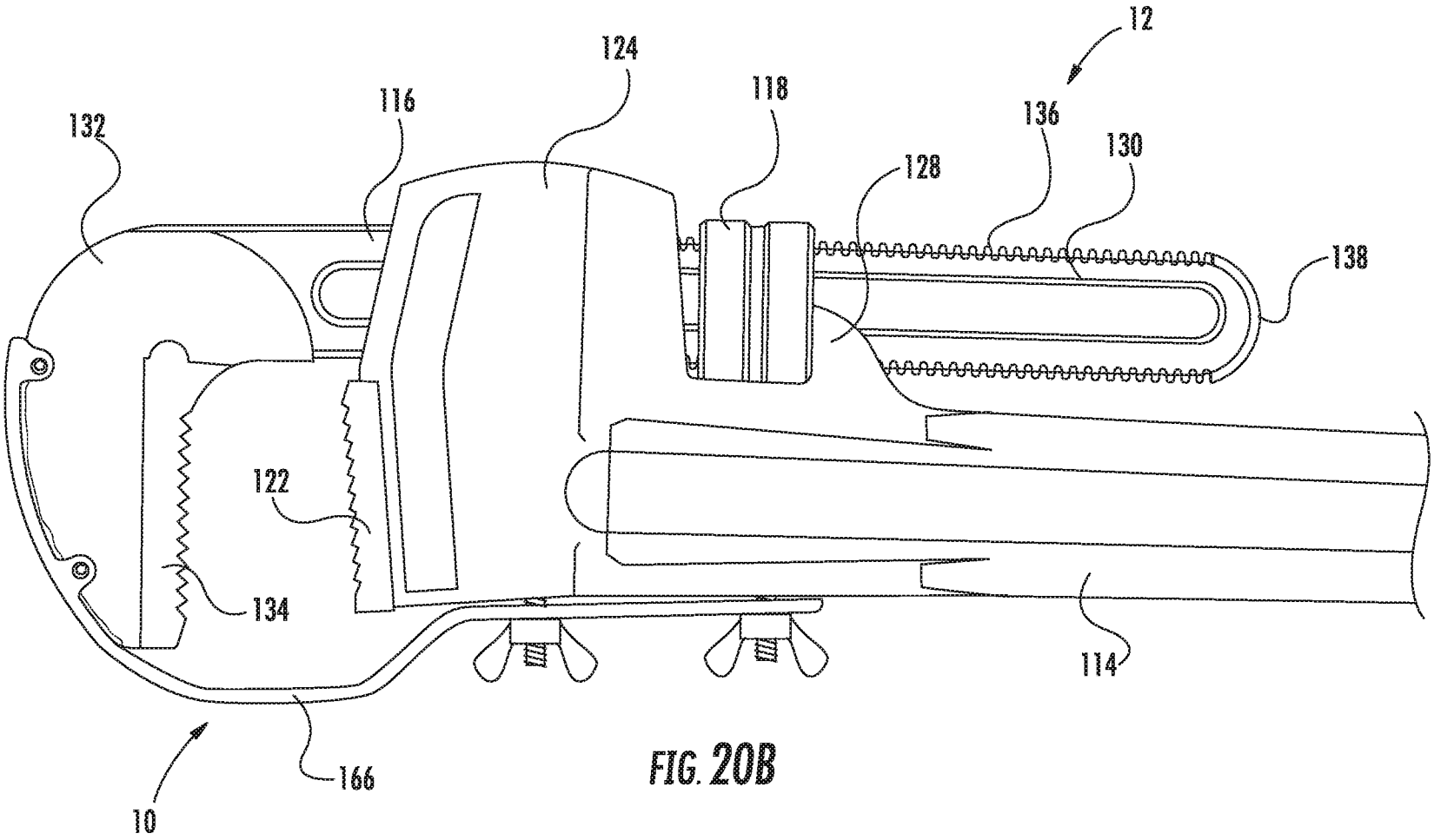

In yet another embodiment of the present disclosure, shown in FIGS. 20A and 20B, the restraint apparatus 10 includes a lanyard device 166 attached to a portion of the hook portion 132 of the L-shaped movable jaw 116 and any other portion of the wrench 114 on the other side of where the L-shaped movable jaw 116 typically fractures. The lanyard device 166 can also be attached to the work object the wrench 12 is engaging, or any other nearby piece of equipment (not shown). In another embodiment, the lanyard device 166 can be set up to extend from the L-shaped movable jaw 116, around the work object and be attached to another portion of the wrench 12. The lanyard device 166 may also be attached to another wrench (not shown) that is being used in tandem with the wrench 12. Each end 168 and 170 of the lanyard device 166 can be attached via any attachment method known in the art, releasably attached or securely attached. Examples of attachment methods include, but are not limited to, adhesive material, shrink wrap, metal rings, crimped metal, fasteners, Velcro®, magnets, braze, and the like.

Figure 21A:
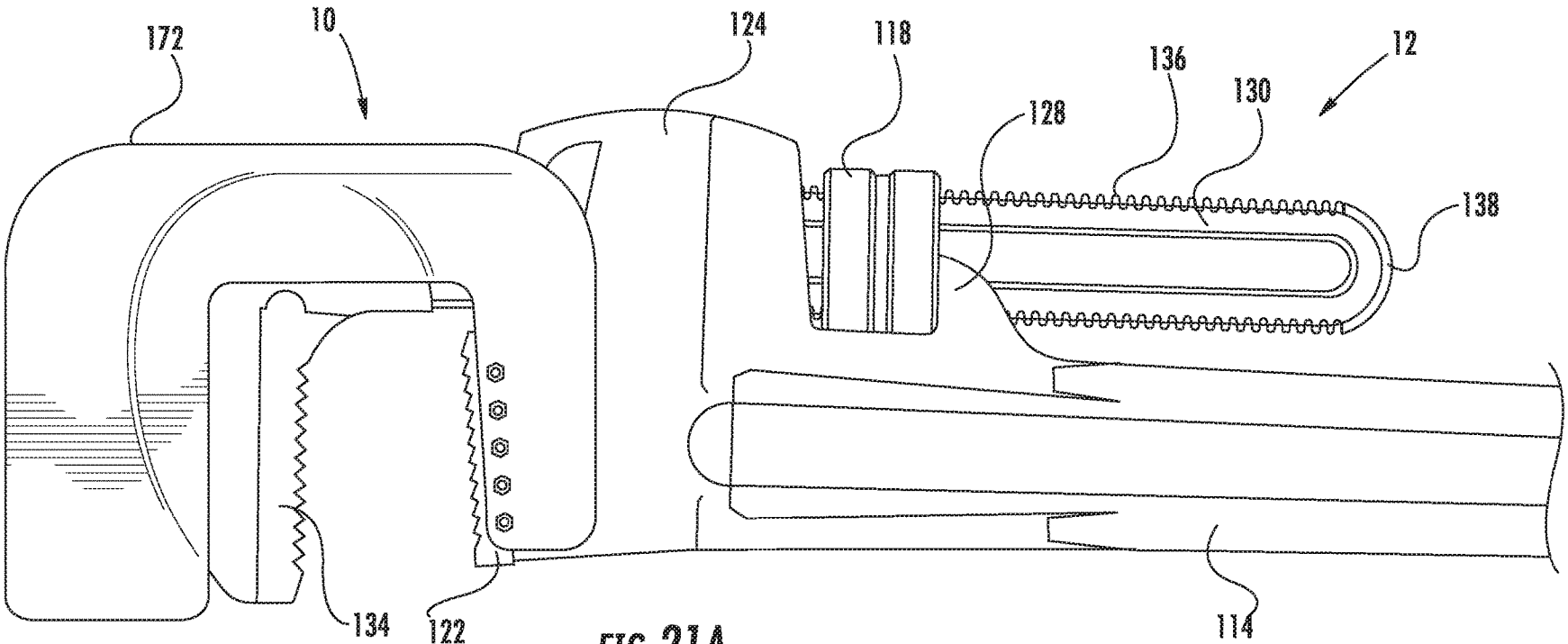
FIG. 21A is a side elevation view of an adjustable wrench including another embodiment of the restraint apparatus constructed in accordance with the present disclosure.
Figure 21B:
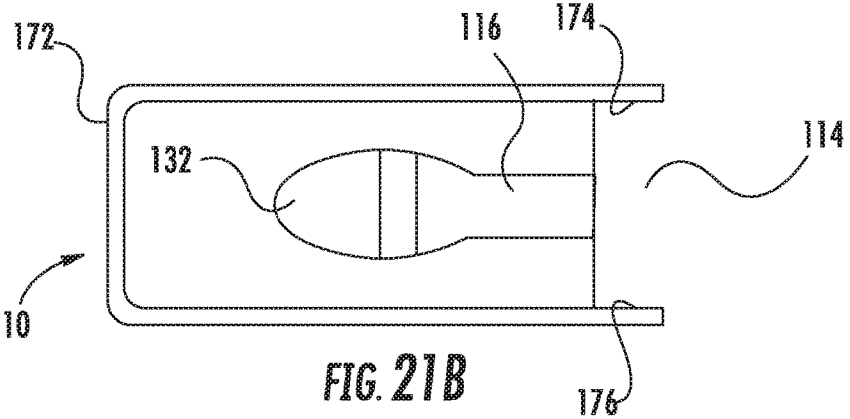
FIG. 21B is a particular view of the adjustable wrench and restraint apparatus shown in FIG. 10A.

In another embodiment of the present disclosure, shown in FIGS. 21A and 21B, the restraint apparatus 10 includes an elastic tension member 172. A portion of the elastic tension member 172 extends from a first side 174 of the handle 114 to a second side 176 of the handle 114 and encapsulates a majority of the hook portion 132 of the L-shaped movable jaw 116 to severely limit the movement of the fractured piece of the L-shaped movable jaw 116. In one embodiment, the elastic tension member 172 can also be secured to a portion of the L-shaped movable jaw 116. The elastic tension member 172 can be secured to the handle 114 or the L-shaped movable jaw 116 via any manner known in the art. Examples of securing methods include, but are not limited to, adhesive material, shrink wrap, metal rings, crimped metal, fasteners, Velcro®, magnets, braze, and the like.

Figure 22:
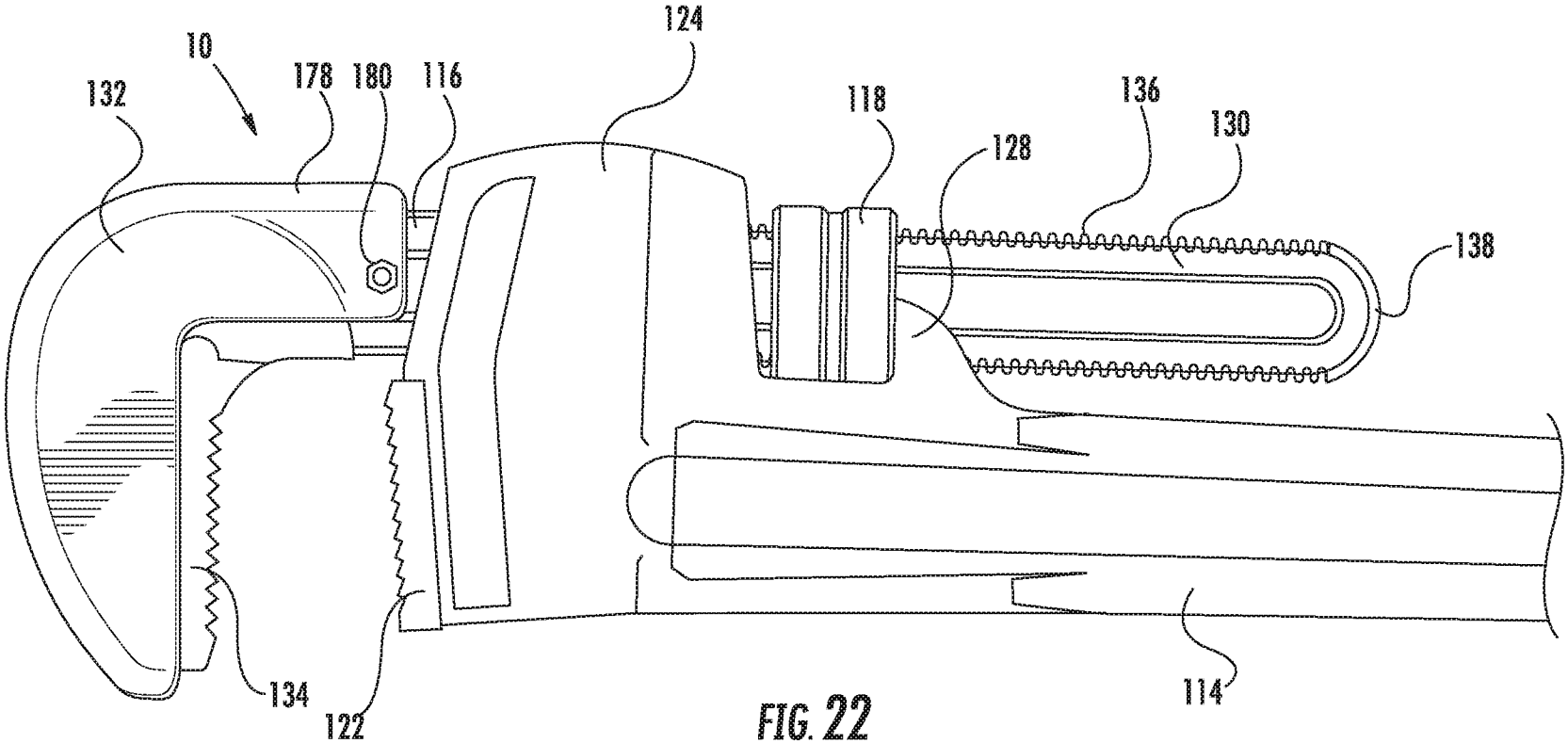
FIG. 22 is a side elevation view of an adjustable wrench including another embodiment of the restraint apparatus constructed in accordance with the present disclosure.

In yet another embodiment of the present disclosure, shown in FIG. 22, the restraint apparatus 10 includes a shroud 178 attached to a portion of the L-shaped movable jaw 116, which encapsulates a portion of the hook portion 132 of the L-shaped movable jaw 116. The shroud 178 may be attached to the L-shaped movable jaw 116 via any securing device 180, such as a bolt or screw. The shroud 178 may also be attached to the L-shaped movable jaw 116 via any manner known in the art. Examples of attachment methods include, but are not limited to, adhesive material, shrink wrap, metal rings, crimped metal, fasteners, Velcro®, magnets, braze, and the like.

Figure 23:
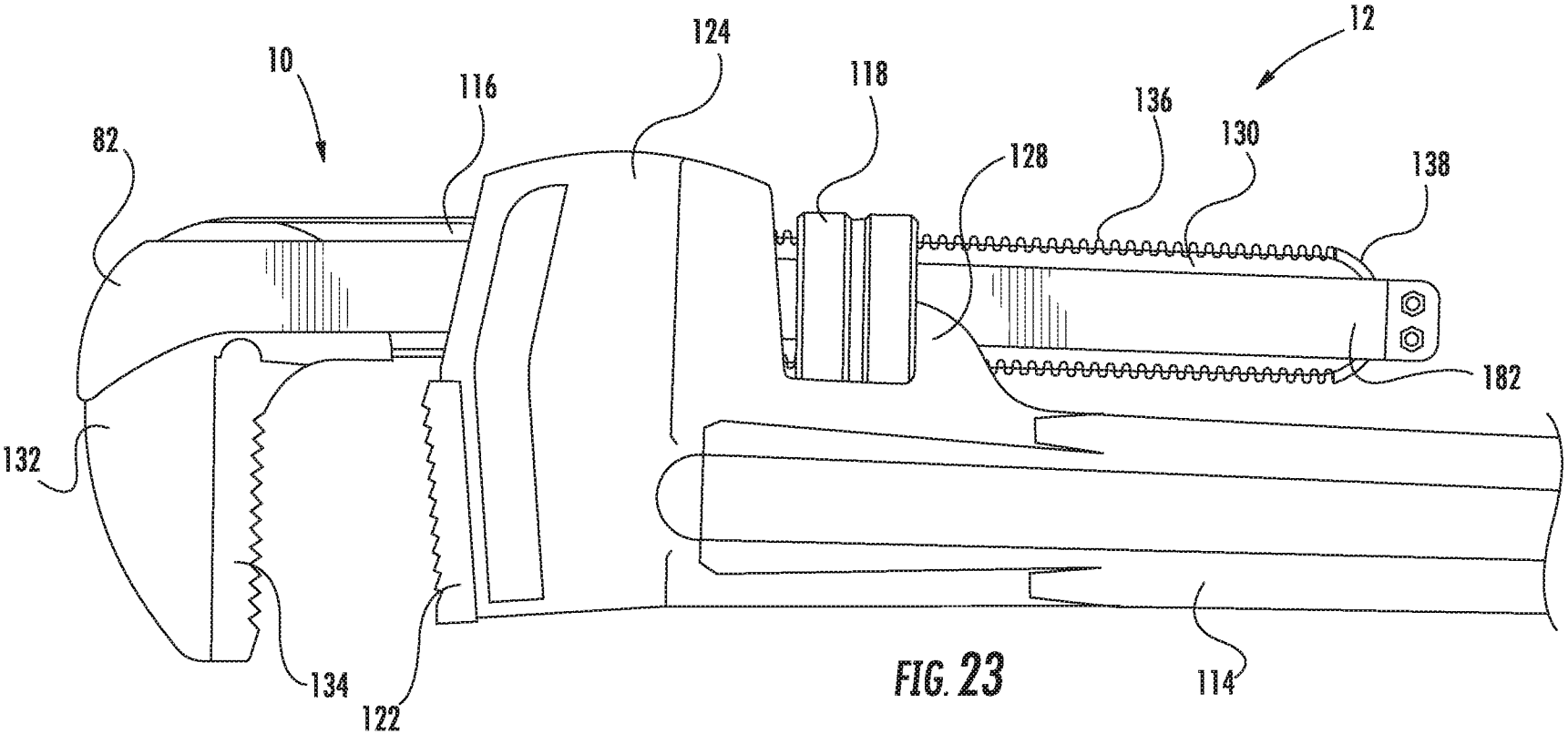
FIG. 23 is a side elevation view of an adjustable wrench including another embodiment of the restraint apparatus constructed in accordance with the present disclosure.

In a further embodiment of the present disclosure, shown in FIG. 23, the restraint apparatus 10 includes a sheet (or strip) of material 182 that extends around the entire length of the L-shaped movable jaw 116 (from the terminal end 138 of the lever arm 130 to the hook portion 132) and the sheet of material 182 is secured to itself. The sheet or strip of material 182 can be metallic or polymeric. The sheet or strip of material 182 can be fastened to itself or the L-shaped movable jaw 116 via any means known in the art. Examples of fastening methods include, but are not limited to, adhesive material, shrink wrap, metal rings, crimped metal, fasteners, Velcro®, magnets, braze, and the like.

From the above description, it is clear that the present disclosure is well adapted to carry out the objectives and to attain the advantages mentioned herein as well as those inherent in the disclosure. While presently disclosed embodiments have been described for purposes of this disclosure, it will be understood that numerous changes may be made which will readily suggest themselves to those skilled in the art and which are accomplished within the spirit of the disclosure.

What is claimed is:

1. A restraint apparatus, the apparatus comprising:

at least one restraint device attached to an adjustable wrench to limit the displacement of a broken portion of the adjustable wrench relative to the adjustable wrench after the adjustable wrench fractures, the adjustable wrench comprising:

a handle having a handle end and a flat serrated jaw surface;

an L-shaped movable jaw having a hook portion, a lever arm, and a serrated jaw, the lever arm having a terminal end; and a projection extending from the handle having a tunnel therein for accepting the lever arm of the L-shaped movable jaw;

wherein the restraint device is secured to two separate areas of the hook portion.

2. A restraint apparatus, the apparatus comprising:

at least one restraint device attached to an adjustable wrench to limit the displacement of a broken portion of the adjustable wrench relative to the adjustable wrench after the adjustable wrench fractures, the adjustable wrench comprising:

a handle having a handle end and a flat serrated jaw surface;

an L-shaped movable jaw having a hook portion, a lever arm, and a serrated jaw, the lever arm having a terminal end; and a projection extending from the handle having a tunnel therein for accepting the lever arm of the L-shaped movable jaw;

wherein the restraint device includes a first layer or strip of material disposed on a portion of the hook portion of the L-shaped movable jaw and a second layer or strip of material is disposed over at least a portion of the layer or strip of material to limit the displacement of the broken portion of the adjustable wrench after the wrench fails.

3. The apparatus of claim 2 wherein the first layer or strip of material is disposed completely around a portion of the hook portion.

4. The apparatus of claim 2 wherein the first layer or strip of material is disposed on an outer portion of the hook portion of the L-shaped movable jaw.

5. The apparatus of claim 2 wherein the first or second layer or strip of material is comprised of a material selected from the group consisting of a polymeric material, an elastomeric material, a metallic material, a shrink wrap material, or a combination thereof.

6. A restraint apparatus, the apparatus comprising:

at least one restraint device attached to an adjustable wrench to limit the displacement of a broken portion of the adjustable wrench relative to the adjustable wrench after the adjustable wrench fractures, the adjustable wrench comprising:

a handle having a handle end and a flat serrated jaw surface;

an L-shaped movable jaw having a hook portion, a lever arm, and a serrated jaw, the lever arm having a terminal end; and a projection extending from the handle having a tunnel therein for accepting the lever arm of the L-shaped movable jaw;

wherein the restraint device is an enclosure device that encapsulates a part of the hook portion to limit the displacement of the broken portion of the adjustable wrench relative to the adjustable wrench after the adjustable wrench fails.

7. The apparatus of claim 6 wherein the enclosure device encapsulates substantially all of the L-shaped movable jaw that extends from the tunnel on the opposite side of the tunnel from the handle while leaving the serrated jaw of the L-shaped movable jaw exposed to engage a work object.

8. The apparatus of claim 6 wherein the enclosure device is secured to the handle, the L-shaped movable jaw, or the handle and the L-shaped movable jaw.

9. The apparatus of claim 6 wherein the enclosure device is constructed of a material selected from the group consisting of a polymeric material, a fabric material, a cloth material, or a combination thereof.

10. A restraint apparatus, the apparatus comprising:

at least one restraint device attached to an adjustable wrench to limit the displacement of a broken portion of the adjustable wrench relative to the adjustable wrench after the adjustable wrench fractures, the adjustable wrench comprising:

a handle having a handle end and a flat serrated jaw surface;

an L-shaped movable jaw having a hook portion, a lever arm, and a serrated jaw, the lever arm having a terminal end; and a projection extending from the handle having a tunnel therein for accepting the lever arm of the L-shaped movable jaw;

wherein the restraint device is a rod element that extends through the L-shaped movable jaw.

11. The apparatus of claim 10 wherein the rod element extends through the lever arm and the hook portion of the L-shaped movable jaw.

12. The apparatus of claim 10 wherein the rod element is a bolt or a rivet.

13. A restraint apparatus, the apparatus comprising:

at least one restraint device attached to an adjustable wrench to limit the displacement of a broken portion of the adjustable wrench relative to the adjustable wrench after the adjustable wrench fractures, the adjustable wrench comprising:

a handle having a handle end and a flat serrated jaw surface;

an L-shaped movable jaw having a hook portion, a lever arm, and a serrated jaw, the lever arm having a terminal end; and a projection extending from the handle having a tunnel therein for accepting the lever arm of the L-shaped movable jaw;

wherein the restraint device includes a C-shaped plate secured to the hook portion of the L-shaped movable jaw.

14. The apparatus of claim 13 wherein the C-shaped plate is secured to one side of the handle and a corresponding side of the hook portion.

15. The apparatus of claim 13 wherein the C-shaped plate includes a first end portion attached to the hook portion and a second end portion attached to the handle, the second end portion having a lip portion disposed thereon to contact a work object when the adjustable wrench fails.

16. The apparatus of claim 15 wherein the C-shaped plate further includes an extension element disposed on the second end portion having an elongated opening disposed therein and the handle has a pin element disposed thereon to engage with the elongated opening to permit the C-shaped plate to extend and retract as the L-shaped movable jaw extends and retracts.

17. A restraint apparatus, the apparatus comprising:

at least one restraint device attached to an adjustable wrench to limit the displacement of a broken portion of the adjustable wrench relative to the adjustable wrench after the adjustable wrench fractures, the adjustable wrench comprising:

a handle having a handle end and a flat serrated jaw surface;

an L-shaped movable jaw having a hook portion, a lever arm, and a serrated jaw, the lever arm having a terminal end; and a projection extending from the handle having a tunnel therein for accepting the lever arm of the L-shaped movable jaw;

wherein the restraint device includes a lanyard device attached to the hook portion and another part of the L-shaped movable jaw or another part of the adjustable wrench.

18. The apparatus of claim 17 wherein one end of the lanyard device is releasably attachable to the adjustable wrench to facilitate the lanyard device's disposal around a work object for which the adjustable wrench is used.

19. A restraint apparatus, the apparatus comprising:

at least one restraint device attached to an adjustable wrench to limit the displacement of a broken portion of the adjustable wrench relative to the adjustable wrench after the adjustable wrench fractures, the adjustable wrench comprises:

at least one handle;

a first jaw having a first gripping surface; and a second jaw having a second gripping surface wherein the second jaw is movable with respect to the first jaw;

wherein the restraint device is secured to two separate areas of the first or second jaw or the restraint device is secured to a portion of the first or second jaw and another part of the adjustable wrench.

20. A restraint apparatus, the apparatus comprising:

at least one restraint device attached to an adjustable wrench to limit the displacement of a broken portion of the adjustable wrench relative to the adjustable wrench after the adjustable wrench fractures, the adjustable wrench comprises:

at least one handle;

a first jaw having a first gripping surface; and a second jaw having a second gripping surface wherein the second jaw is movable with respect to the first jaw;

wherein the restraint device is an enclosure device that encapsulates a part of the first or second jaw to limit the displacement of the broken portion of the adjustable wrench relative to the adjustable wrench after the adjustable wrench fails.

21. The apparatus of claim 20 wherein the enclosure device encapsulates substantially all of the first or second jaw while leaving the gripping surfaces of the first or second jaw exposed to engage a work object.

22. The apparatus of claim 20 wherein the enclosure device is secured to the handles or the first or second jaw.

23. The apparatus of claim 20 wherein the enclosure device is constructed of a material selected from the group consisting of a polymeric material, a fabric material, a cloth material, or a combination thereof.

24. A restraint apparatus, the apparatus comprising:

at least one restraint device attached to an adjustable wrench to limit the displacement of a broken portion of the adjustable wrench relative to the adjustable wrench after the adjustable wrench fractures, the adjustable wrench comprises:

at least one handle;

a first jaw having a first gripping surface; and a second jaw having a second gripping surface wherein the second jaw is movable with respect to the first jaw;

wherein the restraint device is a rod element that extends through the first or second jaw.

25. The apparatus of claim 24 wherein the rod element is a bolt or a rivet.

26. A restraint apparatus, the apparatus comprising:

at least one restraint device attached to an adjustable wrench to limit the displacement of a broken portion of the adjustable wrench relative to the adjustable wrench after the adjustable wrench fractures, the adjustable wrench comprises:

at least one handle;

a first jaw having a first gripping surface; and a second jaw having a second gripping surface wherein the second jaw is movable with respect to the first jaw;

wherein the restraint device includes a C-shaped plate secured to the first or second jaw.

27. The apparatus of claim 26 wherein the C-shaped plate is secured to one side of a first handle and a corresponding side of the first jaw.

28. A restraint apparatus, the apparatus comprising:

at least one restraint device attached to an adjustable wrench to limit the displacement of a broken portion of the adjustable wrench relative to the adjustable wrench after the adjustable wrench fractures, the adjustable wrench comprises:

at least one handle;

a first jaw having a first gripping surface; and a second jaw having a second gripping surface wherein the second jaw is movable with respect to the first jaw;

wherein the restraint device includes a lanyard device attached to the first or second jaw and another part of the adjustable wrench.

29. The apparatus of claim 28 wherein one end of the lanyard device is releasably attachable to the adjustable wrench to facilitate the lanyard device's disposal around a work object for which the adjustable wrench is used or attached to another adjustable wrench.

* * * * *